US005526778A

United States Patent [19]

Springer

[11] Patent Number: 5,526,778

[45] Date of Patent: Jun. 18, 1996

[54] INTERNAL COMBUSTION ENGINE MODULE OR MODULES HAVING PARALLEL PISTON ROD ASSEMBLIES ACTUATING OSCILLATING CYLINDERS

[76] Inventor: Joseph E. Springer, 11247 Monte Vista Avenue, Ontario, Calif. 91762

[21] Appl. No.: 277,920

[22] Filed: Jul. 20, 1994

[51] Int. Cl.[6] ..... F02B 59/00

[52] U.S. Cl. ..... 123/42; 123/70 R

[58] Field of Search ..... 123/42, 316, 48 C, 123/78 C, 70 R, 70 V, 72, 59.7; 92/117 R, 118

[56] References Cited

U.S. PATENT DOCUMENTS

| | | | |
|---|---|---|---|
| 347,603 | 8/1886 | Hodgkinson et al. . | |
| 620,431 | 2/1899 | Eisenhuth . | |
| 644,175 | 2/1900 | Hutchinson . | |
| 778,289 | 12/1904 | Wallmann . | |
| 878,578 | 2/1908 | Thompson | 123/42 |
| 881,310 | 3/1908 | Edwards et al. . | |
| 895,466 | 8/1908 | Johnston . | |
| 920,989 | 5/1909 | Ostergren . | |
| 1,019,856 | 3/1912 | Strickland . | |
| 1,135,365 | 4/1915 | Dock . | |
| 1,276,083 | 8/1918 | Lake . | |
| 1,286,122 | 11/1918 | Sargent . | |
| 1,361,110 | 12/1920 | Spohrer . | |
| 1,374,140 | 4/1921 | Dock | 123/42 |
| 1,383,075 | 6/1921 | Clark . | |
| 1,429,254 | 9/1922 | Rice, Jr. . | |
| 1,695,704 | 4/1926 | Archer . | |
| 1,709,652 | 4/1929 | Bennett . | |
| 1,744,157 | 1/1930 | Browne . | |
| 1,785,176 | 12/1930 | Berner et al. . | |
| 1,821,173 | 9/1931 | Berner et al. . | |
| 1,877,760 | 9/1932 | Berner et al. . | |
| 1,988,309 | 1/1935 | Ford . | |
| 2,078,692 | 2/1935 | Searle . | |
| 2,285,671 | 6/1942 | Mallory . | |
| 2,939,441 | 6/1960 | Luttrell | 123/70 R |
| 3,090,366 | 5/1963 | Nagelmann . | |
| 3,386,424 | 6/1968 | Appeman . | |
| 3,408,811 | 7/1967 | Wishart . | |
| 3,537,437 | 11/1970 | Paul et al. . | |
| 3,621,758 | 11/1971 | Beveridge | 123/42 |
| 3,654,907 | 4/1972 | Bartlett et al. . | |
| 3,747,578 | 7/1973 | Pickens | 123/42 |
| 3,799,140 | 3/1974 | Vogelsang et al. . | |
| 3,815,566 | 6/1974 | Staggs . | |
| 3,934,562 | 1/1976 | Isaka . | |
| 4,075,996 | 2/1978 | Hisserich . | |
| 4,089,630 | 5/1978 | Vollerin et al. . | |
| 4,099,673 | 7/1978 | Heath et al. . | |
| 4,319,552 | 3/1982 | Sauer et al. . | |
| 4,338,897 | 7/1982 | Drumheller et al. . | |
| 4,476,821 | 10/1984 | Robinson et al. . | |
| 4,732,115 | 3/1988 | Lapeyre . | |
| 4,738,230 | 4/1988 | Johnson . | |

(List continued on next page.)

*Primary Examiner*—Marguerite Macy
*Attorney, Agent, or Firm*—Knobbe, Martens, Olson & Bear

[57] ABSTRACT

An internal combustion engine having one or more modules each employing fluidly-communicating, oscillating, power cylinder and air cylinder. The power and air cylinders oscillate about separate, individually supporting sets of trunnions positioned non-linearly with respect to each other and permitting the passage of air therethrough. The air cylinder includes a pre-combustion chamber for the purpose of withholding the delivery of a portion of compressed air to the power cylinder until all spent gases have been evacuated from the power cylinder. The air in the pre-combustion chamber enhances the delivery of fuel from a fuel delivery system into the power cylinder. The power cylinder includes multiple barrels which share a common combustion chamber. Each barrel houses a reciprocating piston linked to discrete piston rods mechanically joined about a single crank throw. A separate air crank throw is linked to an air piston in the air cylinder. The sets of trunnions are supported in linearly movable portions of crank case support plates that permit the trunnion supporting the power cylinder to be moved linearly relative to the power pistons, thus changing the volume of the combustion chamber.

21 Claims, 14 Drawing Sheets

U.S. PATENT DOCUMENTS 4,767,287 8/1988 Marks .
4,964,379 10/1990 August .
5,003,936 4/1991 Scherer ..... 123/48 C
5,025,757 6/1991 Larsen .
5,080,060 1/1992 Huang et al. .
5,136,987 8/1992 Schechter et al. .
5,165,368 11/1992 Schechter .
5,186,137 2/1993 Salzmann .
5,275,134 1/1994 Springer ..... 123/42

Fig. 5
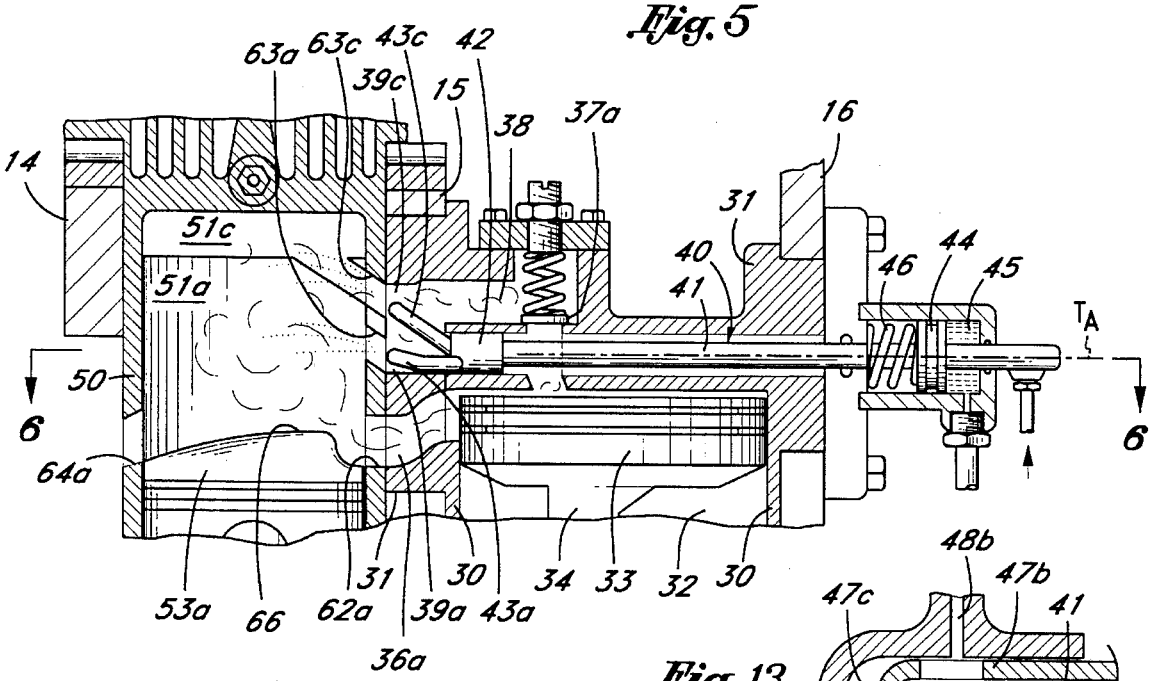
Fig. 13
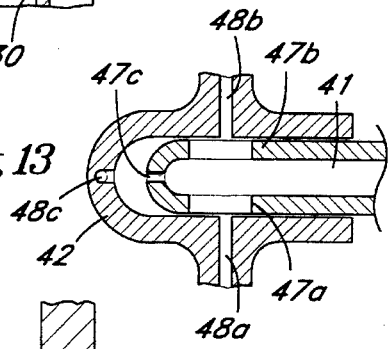
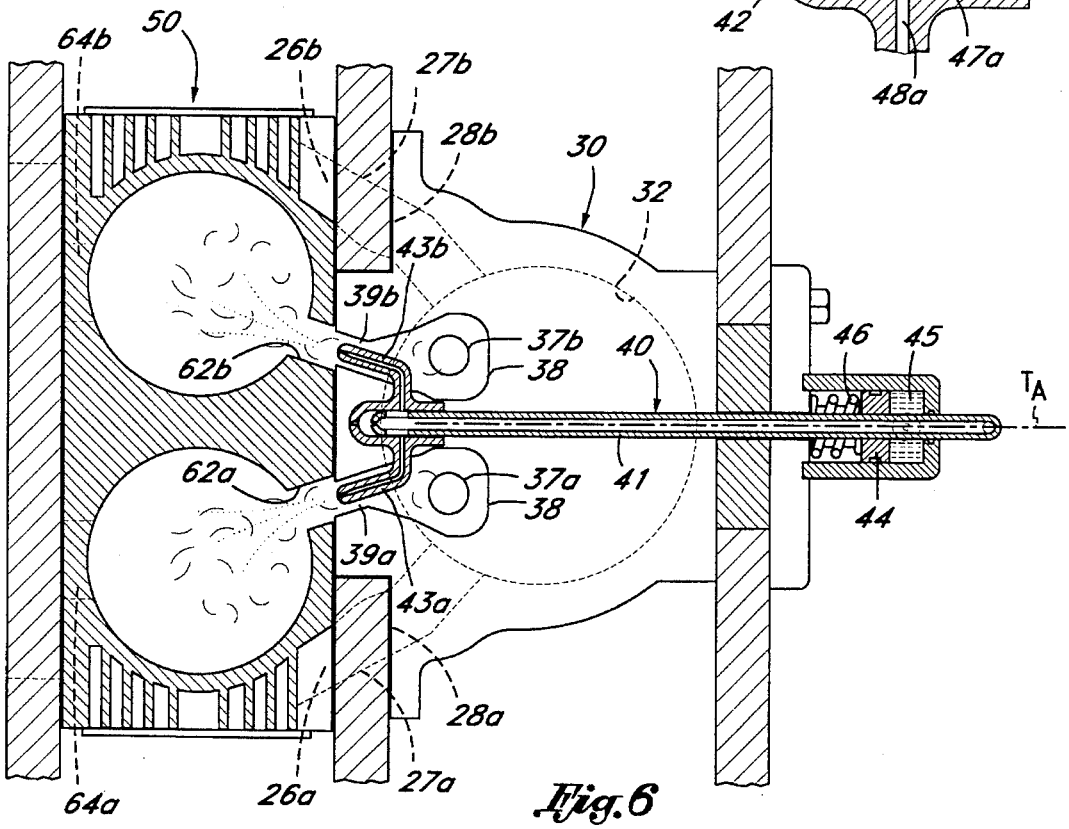
Fig. 6

INTERNAL COMBUSTION ENGINE MODULE OR MODULES HAVING PARALLEL PISTON ROD ASSEMBLIES ACTUATING OSCILLATING CYLINDERS

FIELD OF THE INVENTION

The present invention relates in general to internal combustion engines and, more particularly, to engines having one or more modules that employ pairs of fluidly communicating oscillating cylinders.

BACKGROUND OF THE INVENTION

With conventional internal combustion engines, power is derived from the combustion of air and fuel (e.g., gasoline and air) resulting from the ignition of a highly compressed air-fuel mixture contained within one or more combustion chambers. In a typical internal combustion engine, the inward motion of a reciprocating piston within a cylinder compresses the air-fuel mixture for ignition and combustion. The expanding gases resulting from combustion impart a tremendous force against the piston and drive it outwardly within the cylinder. The piston is typically linked to a crankshaft in a manner such that linear reciprocating motion of the piston is converted into rotational motion of a drive shaft.

A typical sequence of operation of a combustion engine includes delivery of the air and fuel into the combustion cylinder, compression of the air-fuel mixture within the cylinder by the piston, combustion of the mixture which powers the piston and crankshaft, and then exhaust of the "spent" fuel mixture from the cylinder. Repeated performance of these steps results in the continuous delivery of power to the crankshaft which, in turn, can be used to do the desired work, such as propel a motorized vehicle.

Internal combustion engines employing reciprocating pistons may be categorized as "two-stroke" or "four-stroke" engines. The two-stroke cycle engine completes the four steps of the power producing cycle; i.e., fuel intake, compression, power, and exhaust of the spent fuel mixture, during a single reciprocation of the piston (and one resulting revolution of the crankshaft). In contrast, a four-stroke engine requires two revolutions of the crankshaft for a power producing cycle and, thus, two upward and downward strokes of the piston to complete the intake, compression, power, and exhaust steps.

Two-stroke engines typically pre-mix the air and fuel before delivery into the cylinder. The air-fuel mixture is then delivered and the spent combustion gases are exhausted from the cylinder when the reciprocating piston exposes intake and exhaust ports, respectively, in the cylinder walls. Often the piston exposes both the intake and exhaust ports simultaneously, allowing the fresh fuel mixture to purge the cylinder of the exhaust gases. In contrast, the four-stroke engine typically delivers the fuel only after the spent gases have been exhausted and the fuel is frequently delivered into the cylinder separately from the incoming air. Control of the incoming air and exhaust of the spent gases in most four-stroke engines is achieved with an array of mechanically linked intake and exhaust valves.

Two-stroke engines offer certain advantages over four-stroke engines because the former produces power strokes twice as often as compared to the four-stroke engine. This permits two-stroke engines to be smaller in size and lighter in weight than four-stroke engines with a comparable power output. Two-stroke engines are also less expensive to manufacture and build because they require fewer parts that are subject to wear, breakdown and replacement. Two-stroke engines also dispense with the need for a complicated intake and exhaust valve structure.

Two-stroke engines, however, are generally not as efficient as four-stroke engines because two-stroke engines do not effectively remove all of the exhaust gases from the combustion chamber before the next power producing cycle. In a typical two-stroke engine, both the intake port and the exhaust port are open at the same time to enable the new air-fuel mixture to flow into the combustion chamber and to allow the escape of the exhaust gases. The concurrent opening of the intake and exhaust ports allows the fresh air-fuel mixture to purge the exhaust gases out of the combustion chamber through the exhaust port. This is disadvantageous because some of the fresh air-fuel mixture escapes through the exhaust port reducing engine efficiency by failing to utilize all of the fresh air-fuel mixture during the combination process. In addition, some of the exhaust gases mix with the incoming fresh air-fuel mixture which further reduces engine efficiency because noncombustible gases remain in the combustion chamber during the subsequent power cycle.

Efforts to improve the removal of the exhaust gases from the combustion chamber have focused primarily on the development of improved scavenging or removal of the exhaust gases by positively pumping the fresh air-fuel mixture into the combustion chamber. As known in the art, one method uses the changing volume of the crankcase (which changes with the reciprocating movement of the piston) to pressurize the incoming air to help force the exhaust gases out of the cylinder. This approach leads to considerable complexity in crankcase design, requires additional working components, creates sealing and lubrication problems, and adds to the cost of manufacturing, operation and maintenance.

Another known method to improve removal of the exhaust gases from the combustion chamber is to use devices such as a supercharger to force the air-fuel mixture into the cylinder. This subject is discussed at length in the September 1992 issue of Popular Mechanics at page 33. Superchargers comprise a pump that increases the pressure of the air-fuel mixture entering the cylinder. Superchargers generally include a blower that is driven by a belt, gear or chain that is connected to the drive shaft of the engine. However, superchargers include serious disadvantages such as increased weight, added complexity, reliability handicaps, and maintenance problems.

Conventional internal combustion engines also lose power and efficiency because the reciprocating piston is attached to the crankshaft by a connecting rod and a wrist pin to translate linear reciprocating motion of the piston into rotational movement of the crankshaft. The use of the connecting rod and wrist pin results in uneven and excessive wear to the piston and cylinder wall because lateral forces are transmitted through the connecting rod in directions other than through the centerline of the piston. In a typical engine, the cylinders are held stationary in the engine block and the pistons are connected to the rotating crankshaft by the connecting rod which pivots about the wrist pin. When the piston is in any position other than the top dead center or bottom dead center of the cylinder, the force acting through the centerline of the piston is not aligned with the axis of rotation of the crankshaft. Transverse or lateral force vectors, which cause uneven wear of the piston, are created because the force is not acting directly upon the crankshaft.

This disadvantage is overcome by using oscillating cylinders that rotate about a set of trunnions so that the centerline of the piston is at all times aligned with the crank throw of the crankshaft to eliminate the lateral force vectors. The oscillating cylinder engine uses a piston rod that directly connects the piston to the crankshaft to eliminate the need for the wrist pin and connecting rod. The trunnions enable the cylinders to oscillate back and forth across a small arc while tracking the rotational movement of the point of contact between the base of the piston rod and the crankshaft. The rigid, fixed-length piston rod connecting the piston to the crankshaft causes the cylinder to oscillate while the piston rotates semi-elliptical in their motion to turn the crankshaft.

Oscillating cylinder engines of old required a complicated maze of passageways and connections to direct the air-fuel mixture and exhaust gases through the engine. For example, U.S. Pat. No. 878,578 issued to Thompson discloses an engine with two oscillating cylinders. The cylinders are connected by four different passageways to control the flow of the air-fuel mixture into each cylinder and the removal of the exhaust gases from each cylinder. These passageways create a complicated system that is difficult to manufacture and expensive to assemble. U.S. Pat. No. 1,135,365 issued to Dock and U.S. Pat. No. 1,877,760 issued to Berner disclose oscillating cylinder internal combustion engines where the rocking motion created by the oscillating cylinder requires a complex series of chambers, passageways and apertures to regulate the flow of the fuel mixture and exhaust gases through the engine. Thus, prior oscillating cylinder engines required a plurality of passageways and interconnects to control the flow of the air-fuel mixture and exhaust of the spent gases from the combustion chamber.

As shown in my earlier U.S. Pat. No. 5,275,134, I disclosed an internal combustion engine with adjacent air and power cylinders that oscillate about two sets of adjoining co-axial trunnions. The trunnions eliminate the complicated tubing and passageways required to control the flow of the incoming air-fuel mixture and exhaust of the spent gases through the engine because the hollow trunnions periodically align openings or apertures in the air and power cylinder walls to control the flow of the gases through the engine.

It will be readily appreciated that an oscillating cylinder engine that provides complete scavenging or removal of the exhaust gases from the combustion chamber is very advantageous. The engine should allow complete mixing of the air and fuel without the loss of any unburned fuel through the exhaust port. The engine should also be simple, easy to manufacture, lightweight, compact, and require fewer parts than a comparable reciprocating piston engine.

SUMMARY OF THE INVENTION

The present invention is an improved two-stroke, internal combustion engine that employs adjacent air and power cylinders. The air cylinder and power cylinder oscillate via separate and independently supporting sets of trunnions—air trunnions and power trunnions, respectively—that are spaced parallel from each other in non-linear fashion.

The air cylinder houses a single reciprocating piston connected to a first crank throw. The power cylinder houses two separate, but co-acting, power pistons that move in unison within separate barrels. The two power cylinder barrels share a single overhead combustion chamber where compression of the air and ignition of the fuel occurs. The parallel-acting power pistons are each linked to discrete piston rods that are rigidly joined to each other in a manner so as to movably enclose a second crank throw. The first and second crank throw are each mechanically linked to a crankshaft assembly for transferring mechanical power generated by the improved engine. Successful operation of the improved engine depends upon both the air and power pistons being 180° out of phase to accomplish the four steps of a power cycle in proper sequence.

The power trunnions, integral with the power cylinder itself, form a power trunnion conduit (e.g., tube) that is located well above the combustion chamber within the power cylinder in a fully "overhead" position. In contrast, the air trunnions, integral with the air cylinder, are positioned just at or slightly above the compression barrel within the air cylinder.

The air trunnions and power trunnion conduit also serve as passageways, although not in fluid communication with each other. A portion of the power trunnion conduit serves to direct external air from outside the engine through to inlet ports in the air cylinder for compression. A first air trunnion, which is adjacent the power cylinder and which is schematically "down-stream" from the power trunnion conduit, contains a first and second set of air exhaust ports which periodically mate with corresponding first and second sets of inlet ports in the power cylinder. With this arrangement, a large portion of compressed air is delivered to the power cylinder from the air cylinder through the first set of mating ports. This compressed air purges the exhaust gases (remaining from the previous combustion step) in the power cylinder out through the exhaust ports in the power cylinder.

A significant feature of the improved engine is a pre-combustion chamber, located within the head of the air cylinder between the air trunnions, just above the air cylinder barrel. The pre-combustion chamber temporarily stores a small portion of compressed air generated by the air cylinder while the large portion of compressed air purges the power cylinder of spent gases. This advantageously prevents the inadvertent loss of fuel out of the exhaust ports. The pre-combustion chamber also houses discharge nozzles from the fuel delivery system. Fuel from the fuel delivery system, together with the compressed air in the pre-combustion chamber, is directed into the power cylinder under high pressure and velocity through the second set of mating ports in the first air trunnion.

Oscillation of the adjacent cylinders controls the flow of fuel and air into the power cylinder by directing the exhaust ports (of the air cylinder) into and out of alignment with the inlet ports (of the power cylinder) as needed. Oscillation of the cylinders also controls the flow of air from the power trunnion conduit into the air cylinder and controls the flow of "spent" gases out of the power cylinder through its own exhaust ports.

The exhaust ports of the power cylinder are connected to an exhaust conduit external to the power cylinder that directs spent gases through a second portion of the power trunnion conduit and away from the engine.

The fuel delivery system consists of a supply tube axially movable within a fuel injector housing located concentrically with the axis of oscillation of the air trunnions. Fuel flows from a pump through the supply tube and out of nozzles in the pre-combustion chamber. Axial movement of the tube is controlled by hydraulic means to control the fuel entering the pre-combustion chamber. Preferably, the tube has a tapered opening that adjustably overlaps an opening in the fuel injector housing wherein the degree of overlap determines the amount of fuel entering the fuel injector housing. Advantageously, the timing of the delivery of the fuel to the fuel injectors is determined by the oscillating motion of the air cylinder. The tube is held stationary while the fuel injector housing, which is connected to the air cylinder head, oscillates about the end of the tube. This oscillating motion periodically aligns the openings to control the delivery of the fuel to the fuel injectors.

Yet another feature of the improved engine comprises a system for varying the compression ratio of the engine that allows different types of fuel (or fuels with different levels of octane) to be used with the engine. The compression ratio is varied by changing the volume of combustion chamber in the power cylinder. This change is effected by moving discrete sections of crankcase support plates that support the power trunnion conduit such that the power trunnion conduit moves linearly relative to the power piston, thus varying the volume of the combustion chamber.

Another feature of the present invention is an electrical ignition system that depends upon the oscillation of the power cylinder to deliver current to spark plugs. The spark plugs are serviced by a spark plug wire connected to an electrode that is connected to an electrical source such as a battery. As the power cylinder oscillates, the electrode aligns with both electrical contacts to allow electrical current to flow to the spark plugs.

The improved engine described above consists of a single pair of oscillating air and power cylinders to form a single power cycle module. In the preferred embodiment, each module is directly linked by the piston rods to a crankshaft. However, multiple power cycle modules are contemplated, each selectively connected, via respective crankshafts, to a central drive shaft by a slidable output gear. The slidable output gear allows power from each module to be selectively transmitted to the central drive shaft as required.

BRIEF DESCRIPTION OF DRAWINGS

FIG. 5 is an enlarged side view of the air cylinder, power cylinder and fuel delivery system of FIG. 2.

FIG. 6 is a cross-sectional top view of the air and power cylinders of FIG. 5 taken along lines 6—6.

FIG. 8A showing the embodiment of FIG. 7.

FIGS. 8A, 9B, 10B and 11B are fragmentary elevational views of four embodiments of the power cylinder pistons of FIGS. 8A, 9A, 10A and 11A, respectively.

FIG. 8C showing the embodiment of FIG. 7.

FIG. 13 is an enlarged view of the fuel injector housing of the fuel delivery system of FIGS. 5 and 6.

DETAILED DESCRIPTION OF THE PREFERRED EMBODIMENT

Reference is now made to the figures wherein like parts are designated with like numerals throughout. While the accompanying figures show the improved engine oriented vertically, i.e., the pistons moving up and down, it should be readily appreciated that the present invention may be oriented for operation in many directions. For purposes of describing and claiming the present invention on a more general level, pistons will be described as moving inward and outward away from the head of a cylinder, rather than downward or upward, as specifically shown in the figures.

Figure 1:
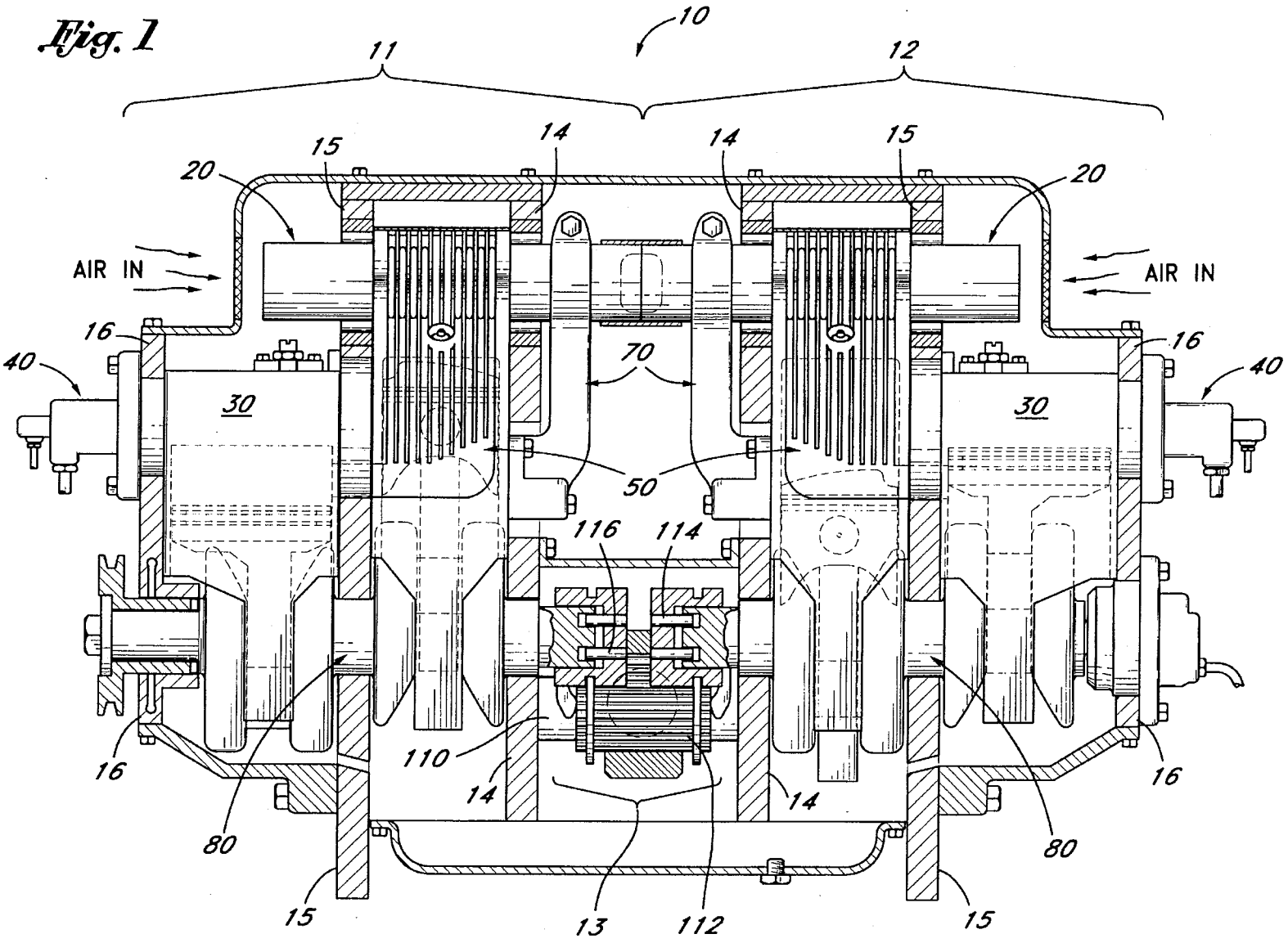
FIG. 1 is a side view of the first preferred embodiment of the present invention showing two mechanically linked side-by-side power cycle modules in virtual mirror image of each other.

With reference to FIG. 1 and by way of broad introduction, the improved engine 10 comprises an air intake system 20 which draws fresh air into the engine 10. This air is first used to draw heat away from the combustion portion of the engine and then is delivered to an air cylinder 30 for compression. The compressed air is, in part, mixed with fuel from a fuel delivery system 40 and delivered under pressure to a power cylinder 50. The balance of compressed air is delivered independently into the power cylinder 50. As described in detail below, the transfer of air and fuel from the air cylinder 30 to the power cylinder 50 is controlled by simultaneous oscillation of both cylinders which periodically brings corresponding inlet and exhaust ports into alignment. Uniquely, the air cylinder 30 and power cylinder 50 are supported by separate sets of trunnions which are non-collinear relationship with each other, as described below. After delivery into the power cylinder 50, the air and fuel mixture is pressurized and ignited for combustion. Subsequent incoming fresh compressed air purges the power cylinder of "spent" gases generated from the combustion process out through an exhaust system 70. Simultaneously, the power produced by combustion of the fuel is directly transferred to a rotating crankshaft assembly 80.

Still referring to FIG. 1, the preferred embodiment of the improved invention 10 comprises side-by-side power modules 11 and 12 each of which comprise a pair of corresponding oscillating cylinders: an air cylinder 30 and power cylinder 50. Each power module 11, 12 includes three parallel and co-extensive crankcase support plates 14, 15 and 16 that support the air cylinder 30 and power cylinder 50 therebetween. Combustion of the fuel and air mixture within each power cylinder 50 of power modules 11, 12 drives rotation of crankshaft assemblies 80 which, in the embodiment of FIG. 1, are linked together via a coupler 13 of any desired configuration.

In addition, to the above combined features, the improved engine 10 of the present invention includes a variable compression ratio system 90 (not shown) that permits use of the improved engine 10 with different types of fuel and different levels of octane. The improved engine 10 also includes a unique electrical ignition system 100 (not shown) which is controlled by the oscillating motion of the power cylinder 50.

For purposes of explaining more clearly the operation of the present invention, reference is now made to the other figures. All components associated with each of the air intake system 20, air cylinder 30, fuel delivery system 40, power cylinder 50, exhaust system 70, crankshaft assembly 80, variable compression ratio system 90 and electrical ignition system 100 will now be described in respective order.

A. Air Intake System

Figure 2:
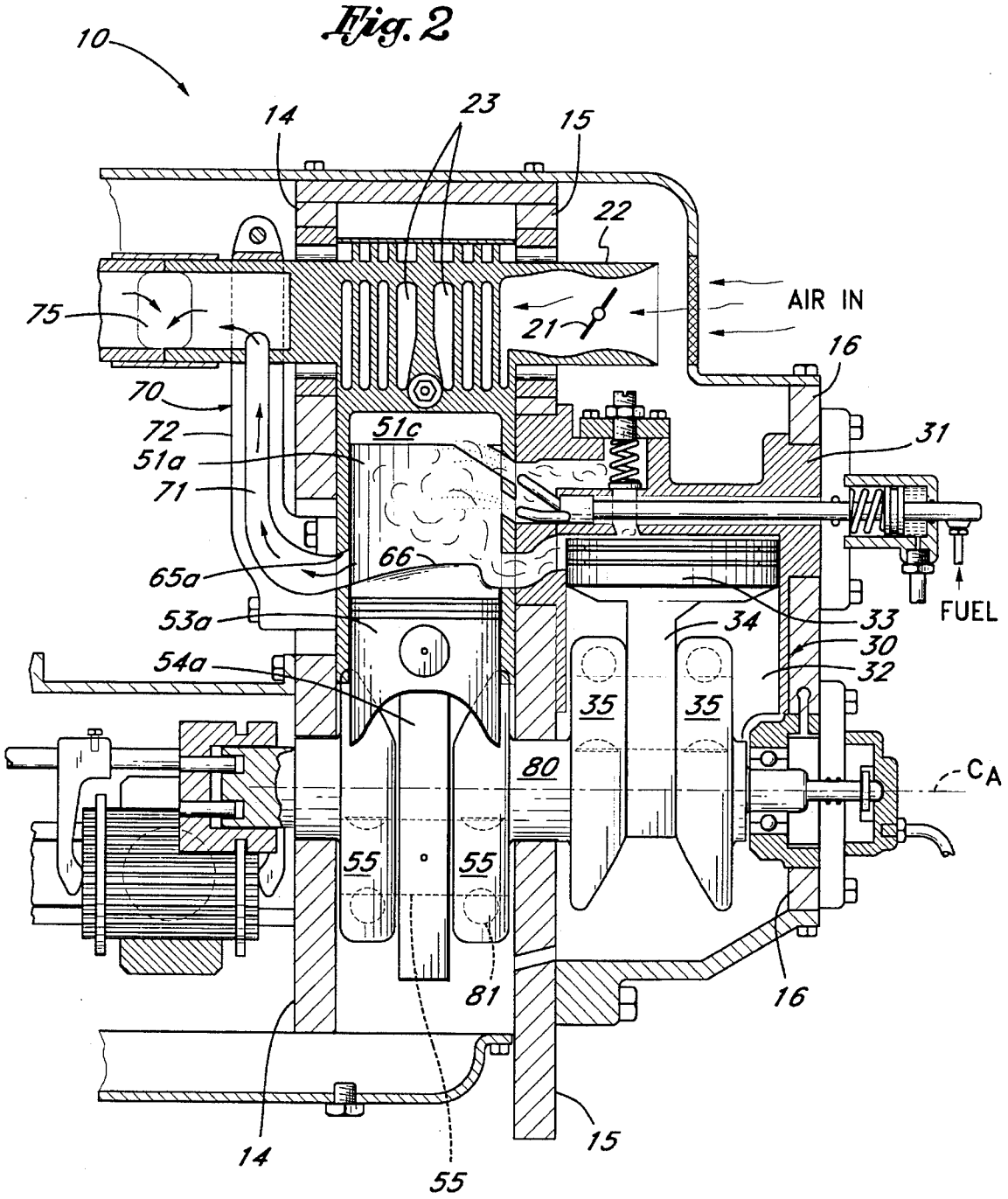
FIG. 2 is a cross-sectional side view of one power cycle module of FIG. 1.
Figure 3:
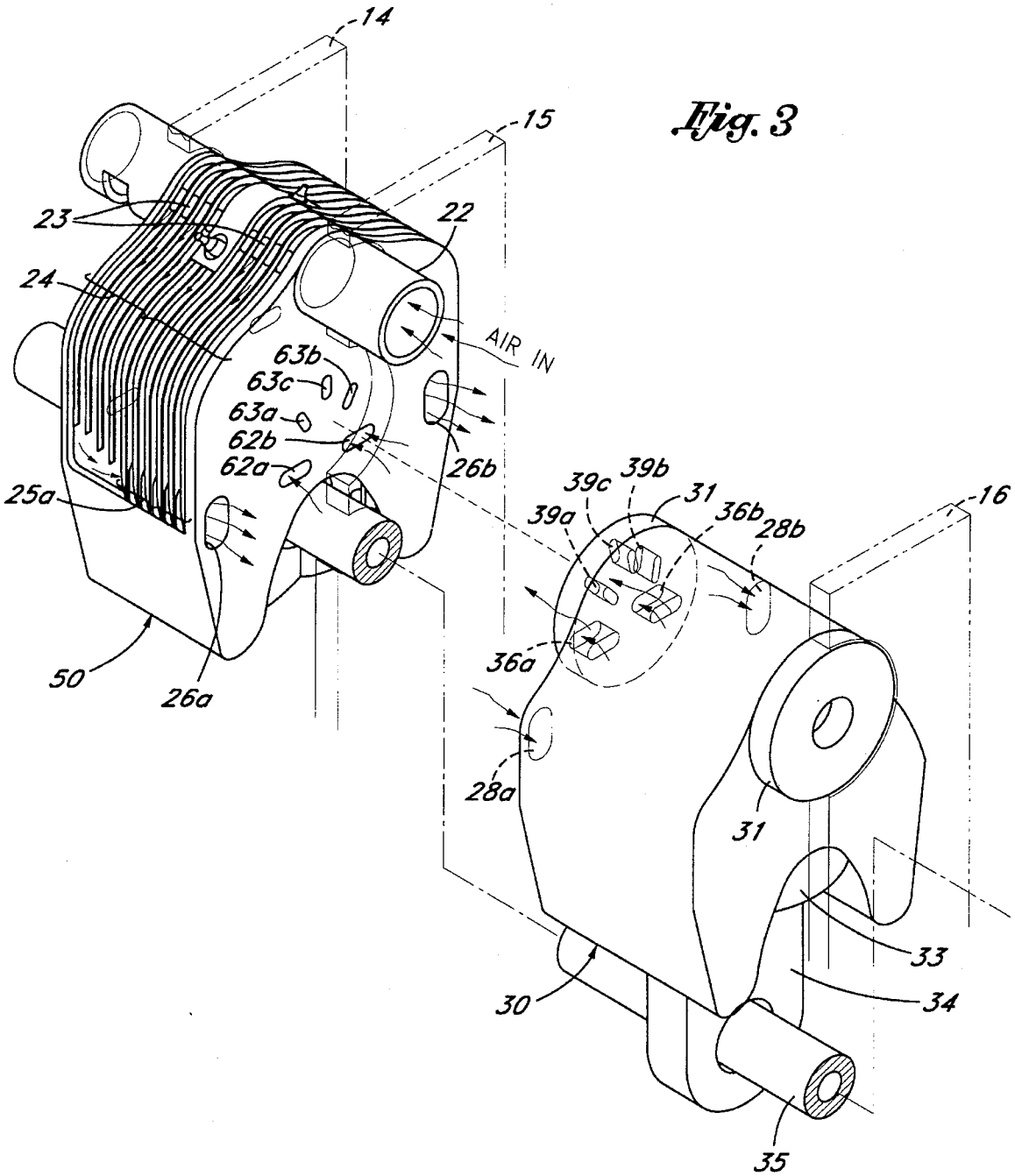
FIG. 3 is an exploded perspective view of the adjacent air cylinder and power cylinder of FIG. 2.

Referring now to FIGS. 2 and 3, the air intake system includes a throttle valve 21 that controls the amount of external air drawn into the engine 10. The air intake system 20 directs the incoming air into a set of power trunnions comprising a hollow tube 22 located substantially overhead of the power cylinder 50. The power trunnion tube 22 supports the power cylinder 50 in an oscillating fashion, as described in further detail below.

As best shown in FIG. 3, the air flowing into the power trunnion tube 22 is directed through openings 23 located in opposing regions of an intermediate portion of the power trunnion tube 22. The air is then directed over radiating flanges or cooling fins 24 located on the exterior surface of power cylinder 50. Air flow over the fins 24 absorbs heat from the power cylinder 50, thereby imparting a cooling effect on the power cylinder 50. This feature may be used either to supplement a separate cooling system or eliminate the requirement of a separate cooling system altogether.

Having drawn heat from the power cylinder 50, the incoming air flow then passes into passageways 25*a* (FIG. 3) and 25*b* (not shown) located on opposite regions of the power cylinder 50. The air exits the power cylinder 50 through discharge ends 26*a,b* of the passageways. Simultaneous oscillation of the power cylinder 50 and air cylinder 30 directs discharge ends 26*a,b* into alignment with corresponding apertures 27*a,b* (not shown) in the crankcase support plate 15 and with corresponding inlet ports 28*a,b* in the walls of the air cylinder 30. This allows the incoming air to be drawn into the air cylinder 30, as explained further below. The momentary, but cyclical, alignment of passageways 25*a,b* with apertures 27*a,b* and inlet ports 28*a,b* is best seen, in phantom, in FIG. 6.

B. Air Cylinder and Related Components

Still referring to FIGS. 2 and 3, the air cylinder 30 oscillates about a set of air trunnions 31. The air trunnions 31 are constructed integrally with the air cylinder 30 and are supported within the opposing crankcase support plates 15 and 16. Support plate 15 also supports the air inlet end of power trunnion tube 22, the other end of which is supported by crankcase support plate 14.

The air cylinder 30 comprises an air cylinder barrel 32 that houses a linearly reciprocating air piston 33. Piston 33 is rigidly affixed to an air piston rod 34 that is, in turn, movably linked to a first crank throw 35 of crankshaft assembly 80. In FIG. 2, the piston 33 is shown in its inward-most (colloquially, "top dead center") position within barrel 32. Unlike conventional internal combustion engines, no wrist pin is included because the piston rod 34 does not move relative to piston 33.

Rotation of crankshaft assembly 80, as generated by forces from the power cylinder, causes rotation of crank throw 35 which transcribes a circular path centered about the axis of crankshaft rotation $C_A$. This circular path, in turn, causes reciprocation of air piston 33 and piston rod 34 within the cylinder barrel 32. Because the piston rod 34 is directly and movably linked to the first crank throw 35,360° revolution of the crank throw 35 causes the air cylinder 30 and trunnions 31 to oscillate relative to crank case support plates 15 and 16. In the preferred embodiment, the range of oscillation for the air cylinder 30 is approximately 15°–25° from vertical in either direction.

As explained above, external air enters the barrel 32 of air cylinder 30 through inlet ports 28*a,b* shown in FIG. 3. The external air is drawn into the cylinder 30 by the partial vacuum created by the outward stroke of piston 33, although a forced air system is also contemplated. Based upon the timing of air cylinder oscillation relative to support plates 15 and 16, fresh air within the barrel 32 of cylinder 30 is then trapped. That is because oscillation of the cylinder 30 directs the inlet ports 28*a,b* out of alignment with passageway outlets 26*a,b*, thus closing off air flow. The inward stroke of the air piston 33 then compresses the air inside the cylinder 30 to high pressures.

Referring now to FIGS. 3 and 5, after the air piston 33 is at its most inward position within barrel 32, a large portion of the compressed air is directed out of a first set of exhaust ports 36*a* (FIGS. 3 and 5) and 36B (FIG. 3 only), each located in one of the (left side) air trunnions 31. Up until that point in the cycle, the exhaust ports 36*a,b* are closed due to blockage by the inward-most position of power pistons in the power cylinder, as described further below. That large portion of compressed air from the air cylinder 30 flows directly into the power cylinder 50 for purposes, in part, of purging "spent" gases from the power cylinder 50.

Immediately before the large portion of compressed air is delivered to the power cylinder, a first portion of compressed air from the cylinder 30 is directed through check valves 37*a* (FIGS. 5 and 6) and 37*b* (FIG. 6) into a pre-combustion chamber 38 and temporarily stored therein. Because the exhaust ports 36*a,b* are closed during the inward stroke of the air piston 33, a build up of pressure occurs within the barrel of the air cylinder 30. Eventually, the pressure reaches a level sufficiently great to overcome the resisting force of the check valves 37*a,b*, thus permitting the delivery of air to the pre-combustion chamber 38.

As described further below, the purpose of the pre-combustion chamber is to temporarily hold compressed air for a time sufficient for the crankshaft assembly to rotate approximately 90° degrees past the closing of power cylinder exhaust ports. The air in the pre-combustion chamber 38 is eventually directed out through a second set of exhaust ports 39*a,b* (FIG. 6) and 39*c* (FIG. 5) and into the power cylinder 50. The second set of ports 39*a–c* are located in the same air trunnion 31 as the first set of exhaust ports 36*a,b* (see FIG. 3). The use of compressed air in the pre-combustion chamber enhances the forceful flow of fuel from the fuel delivery system into the power cylinder 50, as explained further below.

C. Fuel Delivery System

Referring to FIGS. 5, 6 and 13, the fuel delivery system 40, which injects fuel into the power cylinder 50, is concentrically aligned with the axis of rotation of the air trunnions 31 such that a portion of the fuel system is positioned within the pre-combustion chamber 38. The fuel delivery system 40 includes an axially movable tube 41 which is centrally located within an interior passageway above the air cylinder barrel 32 and between check valves 37*a,b*. One end of the tube 41 fits snugly within a fuel injector housing 42 that is rigidly affixed to the interior of the air cylinder head. The fuel injector housing 42 includes three discharge nozzles 43*a,b* (FIG. 6) and 43*c* (FIG. 5) that direct fuel through exhaust ports 39*a–c*, respectively.

The tube 41 and fuel injector housing 42 are positioned so that their longitudinal axis is coaxial with the axis of rotation $T_A$ of the air trunnions 31. Accordingly, the fuel injector housing 42 oscillates in conjunction with the air trunnions 31 as they oscillate within support plates 15 and 16.

The tube 41 moves axially relative to the fuel injector housing 42 pursuant to the force exerted by a hydraulically controlled fuel piston member 44. The piston 44 moves linearly under the countervailing forces of hydraulic fluid 45 pressurized by a master cylinder at gas pedal location (not shown) and an opposing helical spring 46.

Referring specifically to FIGS. 6 and 13, the tube 41 and the housing 42 each have a corresponding set of openings 7*a,b* and 48*a,b* that overlap to a greater or lesser degree depending upon the axial position of the tube 41 relative to the fuel injector housing 42. The tube openings 47*a,b* consist of slots that are preferably tapered. Due to the tapered geometry of slots 47*a,b*, axial movement of the tube 41 relative to the housing 42 determines the amount of fuel delivered through the discharge nozzles 43*a,b* because it directly changes the area of overlap of openings 47*a,b* and 48*a,b*. As should be readily apparent, when the openings 48*a,b* overlap the larger end of tapered openings 47*a,b*, the fuel flow is greater than when openings 48*a,b* overlap the smaller end of tapered openings 47*a,b*.

While axial movement of tube 41 relative to the fuel injector housing 42 controls the volume of flow, oscillation of the air cylinder 30 and fuel injector housing 42 relative to tube 41 turns fuel flow on or off. That is because the mating sets of openings 47 and 48 in the tube 41 and the housing 42, respectively, are sufficiently small that they are in alignment only periodically. When properly timed, the oscillating motion of the air cylinder 30 allows fuel from nozzles 43*a–c* to be directed, along with air from the pre-combustion chamber 38, through the second set of exhaust ports 39*a–c* in air cylinder 30.

The tube 41 and housing 42 also have a third set of corresponding openings 47*c* and 48*c*, respectively. This latter set of openings controls flow to nozzle 43*c* (FIG. 5) and permits continuous flow through nozzle 43*c* into the power cylinder for purposes of maintaining the engine at an idling level. Because the openings 47*c* and 48*c* are positioned coaxially with the axis of oscillation and at the end of the tube 41, neither the oscillation of the air cylinder 30 nor reciprocation of the tube 41 will cutoff flow into nozzle 43*c*.

The air and fuel are forcefully directed into the power cylinder 50 at high pressure to mix with the previously delivered fresh air for purposes of combustion. Dividing the fuel into separate streams and delivering the fuel with compressed air from the pre-combustion chamber 38 advantageously encourages efficient mixing of the air and fuel to enhance combustion.

D. Power Cylinder and Related Components

Figure 7:
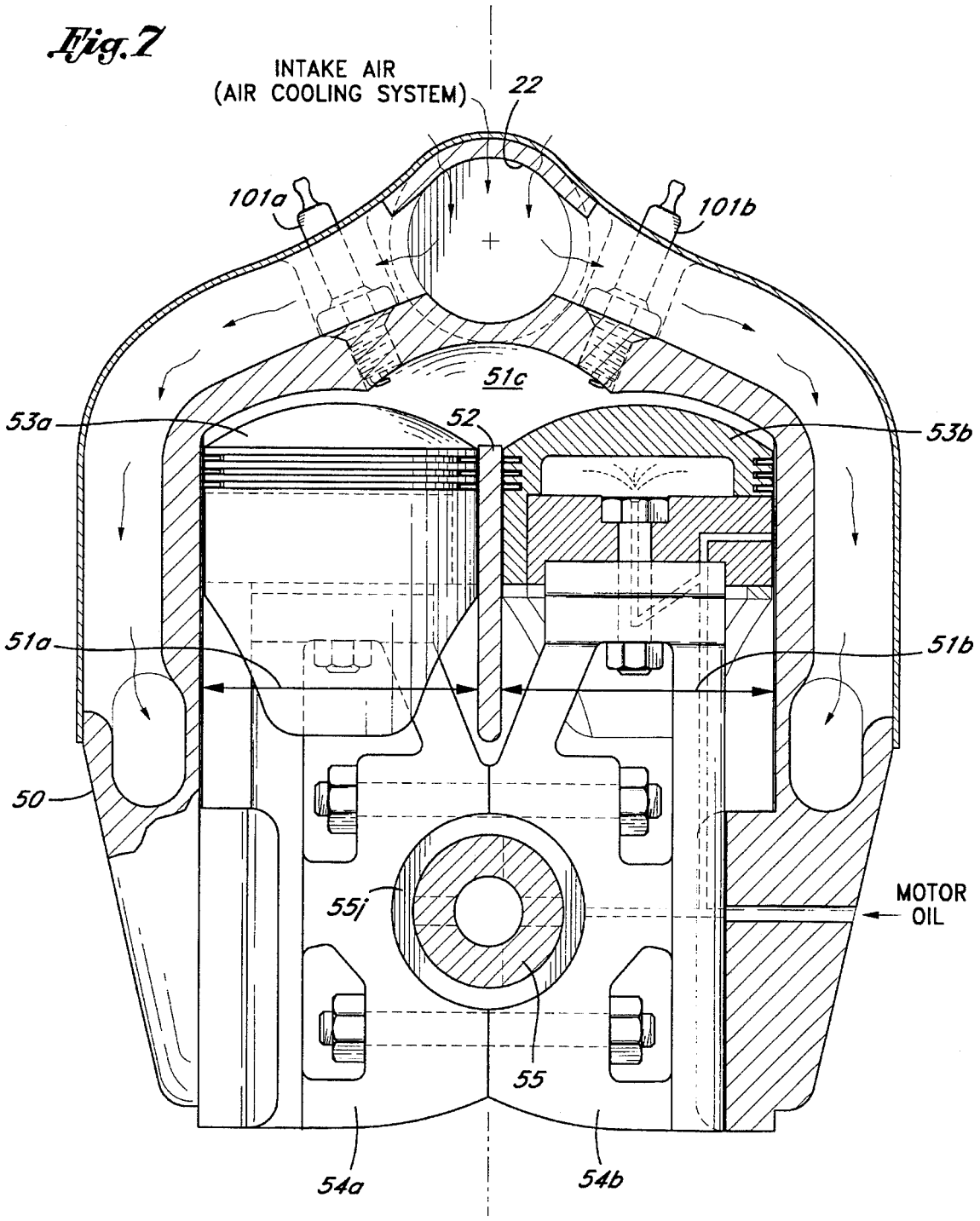
FIG. 7 is an enlarged fragmentary elevational view of the power cylinder of FIGS. 2 and 6.

Referring now to FIGS. 2 and 7, the power cylinder 50 can be described in greater detail. Power cylinder 50 oscillates with the power trunnion tube 22 that is spaced apart from, and parallel to, the set of air trunnions 31 (FIG. 2). The power trunnion tube 22 oscillates within openings in crank case support plates 14 and 15.

The power cylinder 50 comprises two separate barrels 51*a,b*, separated by a chamber wall 52. Above the chamber wall 52 is a common combustion chamber 51*c* where combustion of the fuel and air mixture occurs. Each barrel houses a power piston 53*a* (or 53*b*, FIG. 7) that is mechanically linked to a piston rod assembly. It is also contemplated that the piston be rigidly joined to the piston rod assembly, either as discrete components connected in a non-movable fashion or as a single unitary component having no mechanical connection therebetween.

With regard to the embodiment of FIGS. 2 and 7, the piston rod assembly preferably comprises two discrete piston rods 54*a,b*. (Alternative piston rod assemblies are described below in association with FIGS. 9–11). Like the air piston rod 34 of air cylinder 30, the power piston rods 54*a,b* are movably coupled to a second crank throw 55 of crankshaft assembly 80 via journal 55*j*. The power piston rods 54*a,b* are rigidly joined to each other in one of several selected arrangements, as described further below, such that the mechanically joined rods 54*a,b* enclose the second crank throw 55 in rotating engagement. This arrangement permits mechanical forces generated from combustion to be transferred through the piston rods 54*a,b* to the crank throw 55 while permitting rotation of the crank throw 55 within the journal 55*j*. In response to these forces, the crank throw 55 transcribes a circular path about an axis of rotation $C_A$ (FIG. 2) of the crankshaft assembly 80, thereby causing oscillation of the power cylinder 50 with the power trunnion tube 22 within support plates 14 and 15. In the preferred embodiment, the oscillating power cylinder 50 transcribes an arc in the range of 10°–20° on either side of the vertical axis.

Figure 8A:
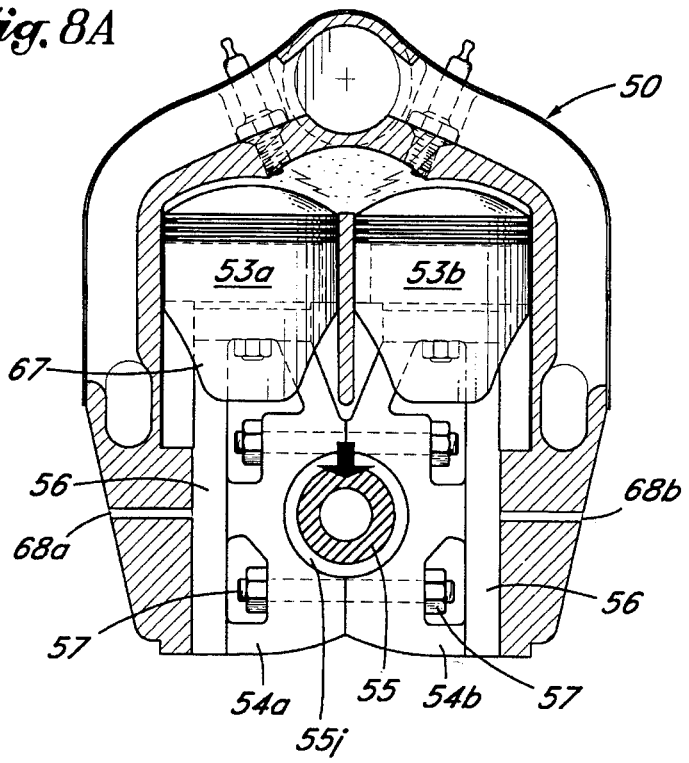
FIG. 8A, 9A, 10A and 11A are fragmentary elevational views of four embodiments of the two-barrel power cylinder of the present invention.
Figure 8B:
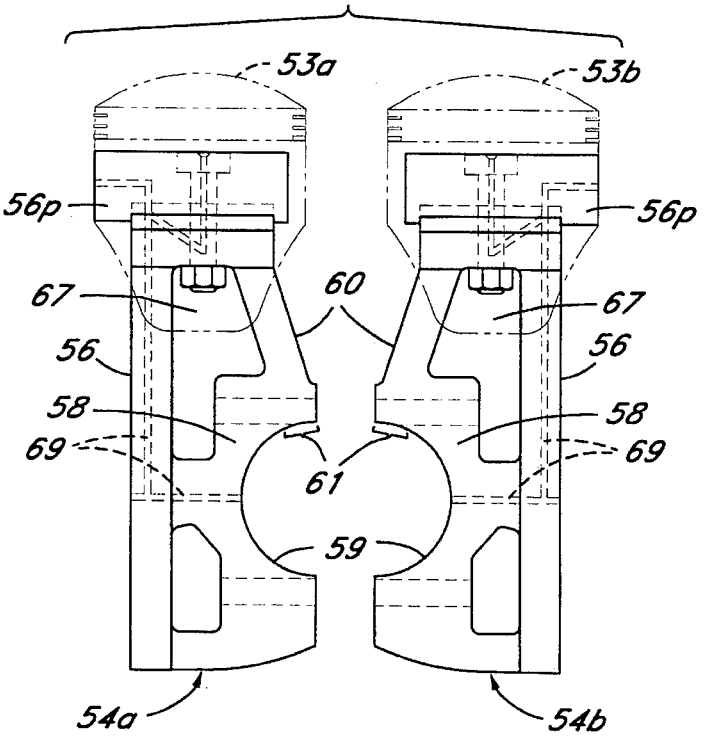
FIG. 8B showing the embodiment of FIG. 7.
Figure 8C:
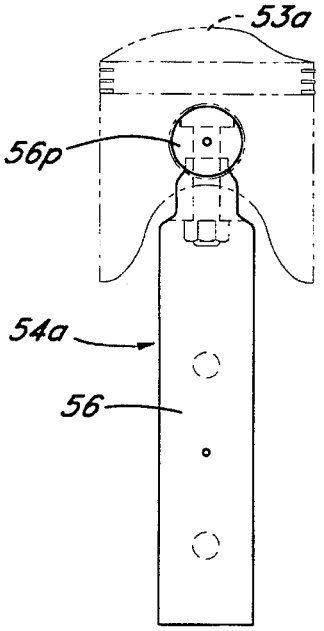
FIGS. 8C, 9C, 10C and 11C are fragmentary side views of the power cylinder pistons of FIGS. 8B, 9B, 10B and 11B, respectively.

Referring to FIGS. 8A, 8B and 8C together, the first embodiment of power cylinder components, also shown in FIG. 7, can be described in even greater detail. Each piston rod 54*a,b* consists of an elongate member 56 that extends below the pistons 53*a,b*, as shown more prominently in FIG. 8B. The piston rods 54*a,b* are connected to the pistons 53*a,b* via pins 56*p*. The elongate members 56 are connected to each other by mechanical fasteners such as bolts 57 (FIG. 8A) that extend through flanges 58 about an opening 59 (FIG. 8B). The opening 59 is sized to fit about the journal 55*j* and the power crank throw 55 in a rotationally engaging manner. The piston rod 54*a,b* also include an angled member 60 (FIG. 8B) that extends between the corresponding power piston 53*a,b* and the opening 59 for the crank throw 55.

A significant feature of this embodiment is that the angled members 60 allow some of the force from the dual power pistons 53*a,b* to be transferred directly to the power crank throw 55 through regions 61. This causes the downward force of the dual power pistons 53*a,b* to "push" the power crank throw 55 of the crankshaft assembly 80 downwardly during the power stroke of the power cylinder 50, as shown by the bold arrow.

Figure 9A:
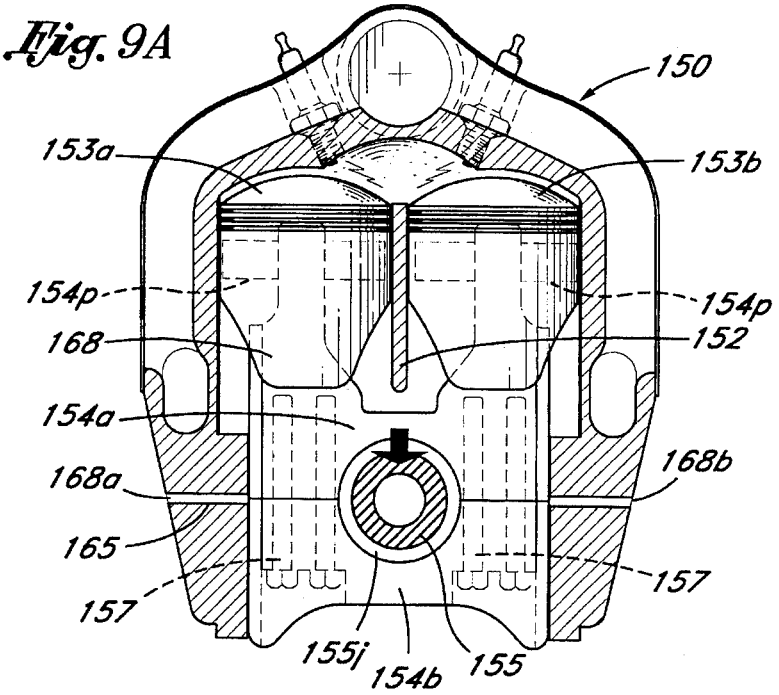
Figure 9B:
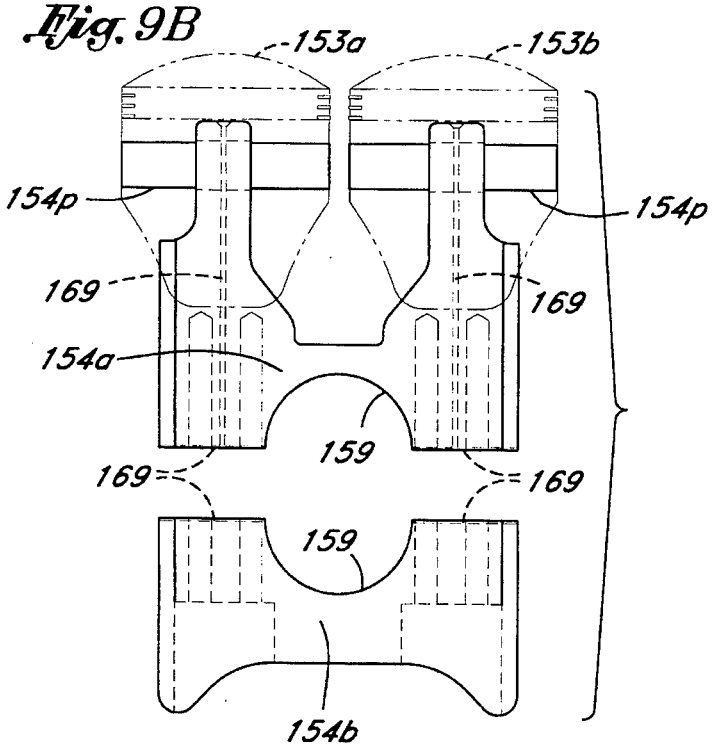
Figure 9C:
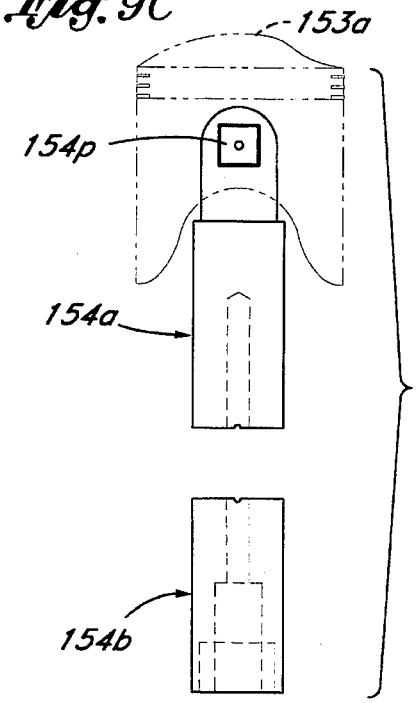

An alternative embodiment of the power cylinder piston rod assembly is illustrated in FIGS. 9A–C in which the two pistons 153*a,b* are rigidly affixed via pins 154*p* to a unitary first connecting link 154*a* that spans the diameter of the base of the power cylinder below the barrel dividing wall 152. The first connecting link 154*a* is mechanically connected to a second connecting link 155*b* by mechanical means such as bolts 157 shown in phantom. Both connecting links 154*a,b* have mating semicircular channels to form an opening 159 that encircles a crank throw journal 155*j* and crank throw 155 (FIG. 9B). The downward movement of the dual power pistons 153*a,b* "pushes" the power crank throw 155 downwardly during the power stroke of the power cylinder 150, as shown by the bold arrow.

Returning back to FIGS. 3 and 5, other components of the power cylinder can be described. Referring first to FIG. 3, it can be seen that air cylinder exhaust ports 36*a,b* and 39*a–c* mate with corresponding sets of inlet ports 62*a,b* and 63*a–c* in the power cylinder 50, respectively. FIG. 5 shows exhaust port 36*a* mating with inlet port 62*a* and exhaust port 39*a* mating with inlet port 63*a*. The other ports not shown are positioned directly behind those shown, as appreciated from FIGS. 3 and 6. FIG. 5 also shows exhaust port 39*c* mating with inlet port 63*c*, wherein inlet port 63*c* extends up through barrel wall 52 into combustion chamber 51*c*. With this arrangement, a certain amount of fuel and air is delivered through power cylinder inlet ports 63*a,b* to separate barrels 51*a,b*, respectively. Fuel and air is also delivered, through nozzle 43*c* (FIG. 5), directly to the combustion chamber 51*c*.

Figure 4:
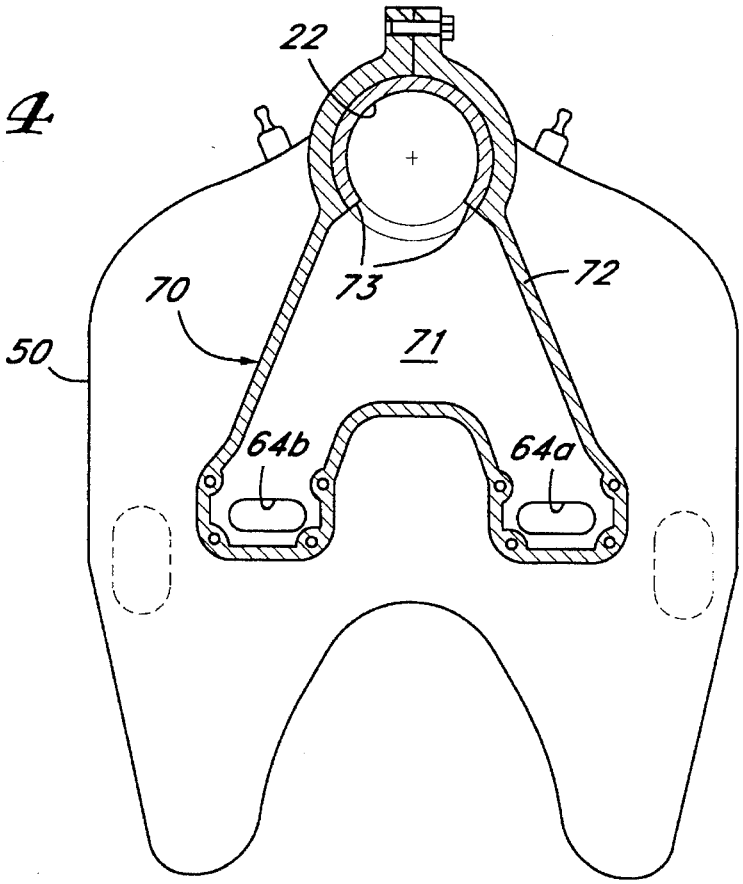
FIG. 4 is a rear view of the power cylinder of FIG. 2 showing the power cylinder exhaust ports and the exhaust system in fluid communication therewith.

As can now be appreciated, oscillation of the power cylinder 50 and the air cylinder 30 periodically aligns the two sets of power cylinder inlet ports with the two sets of air cylinder exhaust ports to control the flow of air between cylinders. However, it must be understood that inlet ports 63*a–c* (FIG. 3) and exhaust port 39*a–c* cannot be in alignment at the same time that inlet ports 62*a,b* and exhaust ports 36*a,b* are in alignment. Otherwise, air from the air cylinder and the air/fuel from the pre-combustion chamber would enter the power cylinder at the same time. This is not desired because fuel may be inadvertently lost from the power cylinder prior to combustion. If properly timed, the delivery of air from the pre-combustion chamber 38 to the power cylinder 50 should occur only after the large portion of air from the air cylinder 30 has entered the power cylinder through inlet ports 62*a,b* and has purged the power cylinder 50 of spent gases. These spent gases are directed out of the power cylinder 50 through exhaust ports 64*a,b* (FIGS. 4 and 5). By this time, the power piston 53 has moved sufficiently inward within the power cylinder 50 to close off inlet ports 62*a,b* and exhaust ports 64*a,b*, permitting the introduction of air/fuel from the pre-combustion chambers.

The flow of air either entering through the inlets ports 62*a,b* or exiting the exhaust ports 64*a,b* is controlled not only by simultaneous oscillation of the air cylinder 30 and the power cylinder 50, but also by the reciprocating movement of power pistons 53*a,b* through barrels 51*a,b*. When each of the power pistons 53*a,b* is at or near its outward-most position ("bottom dead center") of the power cylinder 50, the incoming fresh air charge is able to flow through inlets 62*a,b* into the power cylinder 50. Simultaneously, the exhaust gases are able to exit the cylinder through exhaust ports 64*a,b*. As the power pistons 53*a,b* begin to move inward, they block the inlet ports 62*a,b* and the exhaust ports 64*a,b* in the power cylinder 50. The inlet ports 62*a,b* and exhaust ports 64*a,b* remain closed during all inward movement of the power pistons 53*a,b* because an annular piston skirt 67 (FIGS. 2 and 7) extending outwardly from each power piston covers these inlet and exhaust ports. The alternative embodiment of FIG. 9A shows pistons 153*a,b* with a similar skirt 168. While FIG. 2 shows the exhaust ports positioned distal from the power trunnion conduit 22, permitting two-stroke application, the present invention contemplates locating one or more exhaust ports closer to the inward-most portion of the power cylinder 50 so that the engine can be operated in a four-stroke fashion, if properly timed. In the latter case, closing of the exhaust ports would depend purely upon oscillation of the power cylinder relative to the exhaust system 70, rather than reciprocation of the power pistons relative to the exhaust ports.

As best seen in FIG. 5, power pistons 53*a,b* each include a raised ridge 66 that acts as a baffle and enhances the removal of the spent gases from the power cylinder 50. The surface of each piston 53*a* or 53*b* contains a steeply sloped surface below the raised ridge 66 and proximate the inlet ports 62*a,b* to direct the air inwardly towards the head of the power cylinder 50. This causes the fresh air to circulate throughout the power cylinder 50, scavenging the exhaust gases out exhaust ports 64*a,b*. The raised ridge 66 also serves the purpose of more effectively dispersing the fuel entering through inlet ports 63*a* and 63*b*, which enhances mixing of the fuel and air and increases efficient combustion of the fuel. As the fuel enters the power cylinder, that portion of the fuel delivered through inlet ports 63*a* and 63*b* into barrels 51*a* and 51*b*, respectively, strikes the ridge 66 and disperses.

E. Exhaust System

Figure 12:
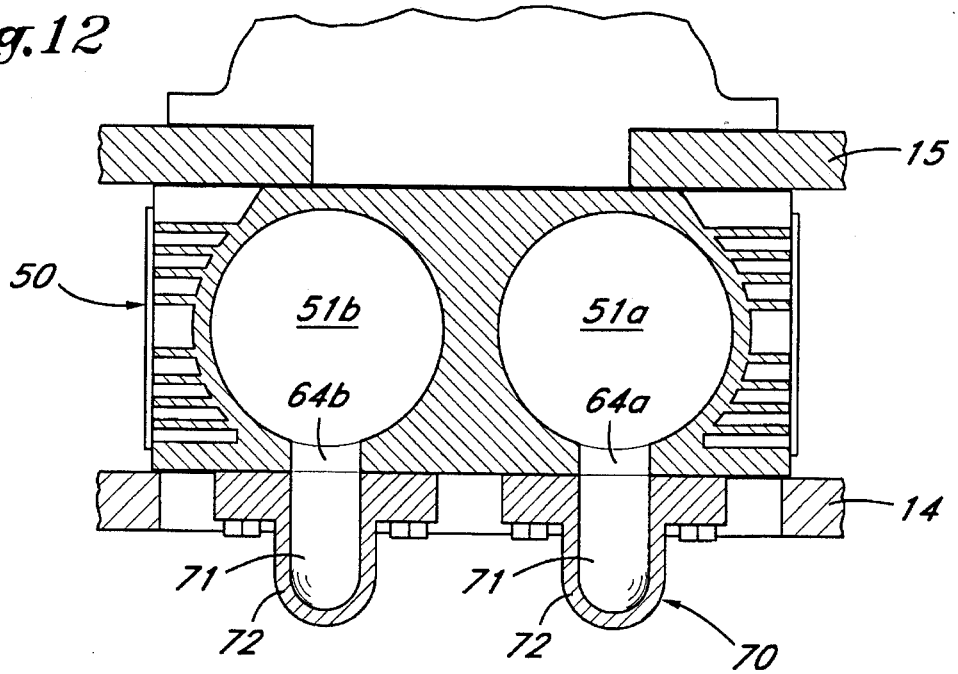
FIG. 12 is a cross-sectional top view of the power cylinder of FIG. 4 showing the power cylinder exhaust ports and the exhaust system in fluid communication therewith.

As seen in FIGS. 2, 4 and 12, the exhaust ports 64*a,b* are connected to the exhaust system 70. The exhaust system 70 comprises a single passageway 71 in conduit member 72 that directs the spent gases from the power cylinder 50 to an opening 73 in the power trunnion tube 22. The conduit member 72 is securely fastened to the power cylinder 50 by mechanical fasteners such as bolts 74. The spent gases traverse the passageway 71, enter the power trunnion tube 22 at opening 73, and exit the power trunnion tube 22 through engine exhaust opening 75. The exhaust gases are then directed away from the engine 10. Reference is also made to FIG. 1, where exhaust from two separate power modules 11, 12 are manifolded together in a single shared power trunnion tube 22.

Referring to FIGS. 8A and 9A, the improved engine 10 also includes a plurality of passageways in the power cylinder 50 to promote the flow of oil within the cylinder. With the embodiment of FIG. 8A, the oil enters the power cylinder 50 through inlet ports 68*a,b* and is directed inwardly to the piston rods 54*a,b*. With the embodiment of FIG. 9A, oil enters the power cylinder 150 through inlets 168*a,b* and is directed inwardly to the connecting links 154*a,b*.

Referring now to FIG. 8B, the oil travels through the piston rods 54*a,b* through passageways 69 shown in phantom. With this arrangement of passageways as shown, oil can be delivered to piston pins 56*p*, piston skirts 67 and crank throw journal 55*j* (FIG. 8A). It is contemplated that the embodiment of FIG. 8B also include opposing piston buttons (not shown) positioned on opposite sides of the piston pins 56*p*. These buttons will be slidable within the pins under the pressure of the oil to assist in maintaining alignment of the pistons as they reciprocate within the oscillating power cylinder.

Referring to the alternative embodiment of FIG. 9B, oil is directed to the connecting links 154*a,b* through passageways 169 formed by the junction of the connecting links 154*a,b*. Channels 169 direct the oil to pins 154*p*, piston skirts 168 and crank throw journal 155*j* (FIG. 9A).

Figure 10A:
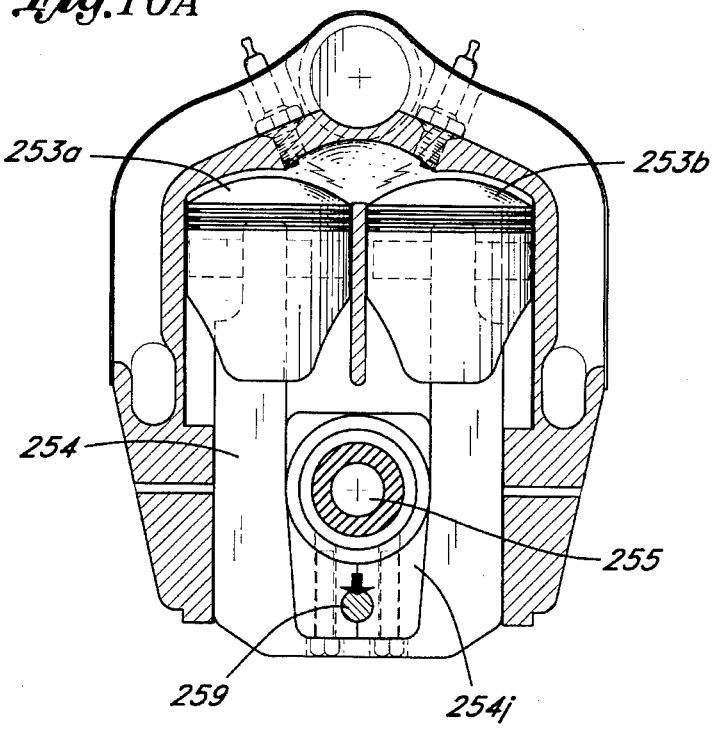
Figure 10B:
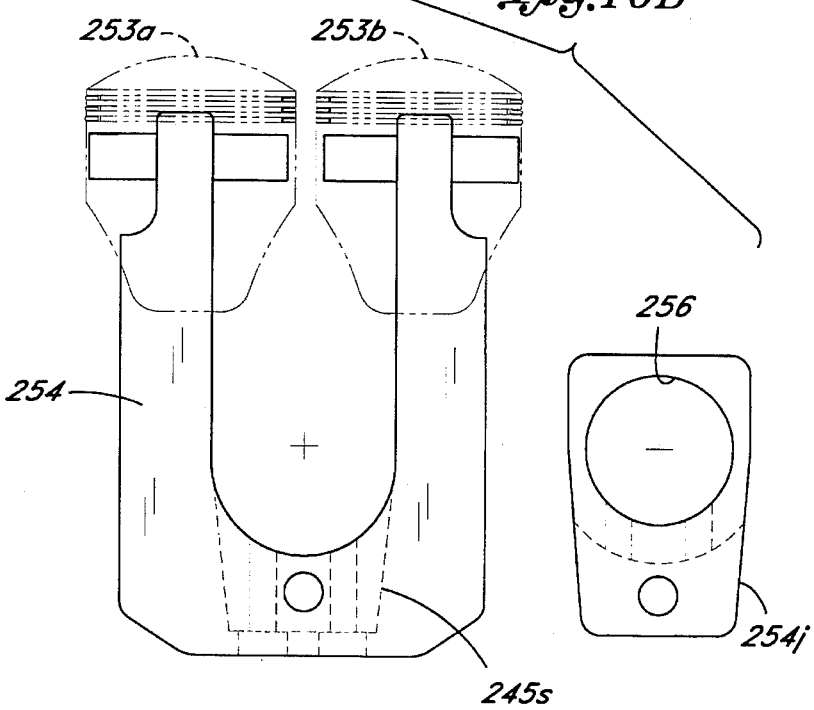
Figure 10C:
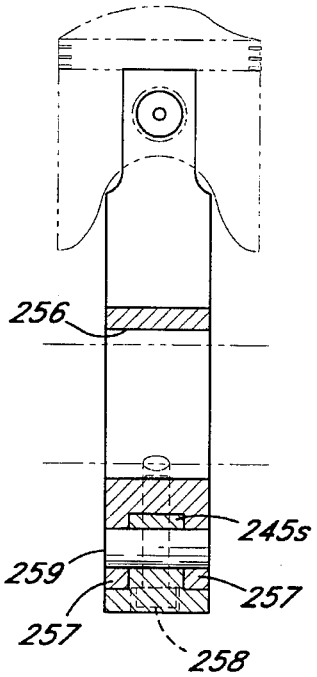

Two other embodiments of power cylinder piston rod assemblies are contemplated beyond those shown in FIGS. 8A and 9A. Referring now to FIGS. 10A–C and 11A–C, it can be seen that the two pistons 253*a,b* are jointly supported by a unitary "U"–shaped piston rod 254. Referring first to FIGS. 10A–C, the "U"–shaped piston rod 254 is connected to a journal 254*j* that movably engages the power crank throw 255 by way of opening 256 (FIG. 10B). FIGS. 10B and 10C show that the journal 254*j* includes downwardly extending flanges 257 that straddle a seat 254*s* on the "U"–shaped piston rod 254. The "U"–shaped piston rod 254 and journal 254*j* are securely connected by mechanical fasteners such as bolts 258 (shown in phantom).

Referring back to FIG. 10A, during operation, the downward movement of the dual power pistons 253*a,b* causes the U-shaped piston rod 254 to simultaneously move outward. The outward force of the U-shaped piston rod 254 is transmitted to the journal 254*j* via a pin 259 and ultimately to the power crank throw 255 of the crankshaft assembly (not shown). Thus, as indicated by the arrow, the outward force of the dual power pistons 253*a,b* "pulls" the crank throw 55 downwardly through U-shaped piston rod 254 and journal 254*j*, rather than pushing it down as accomplished by the embodiments of FIGS. 8A–C and 9A–C. The embodiment of FIGS. 11A–C operates similarly.

Figure 11A:
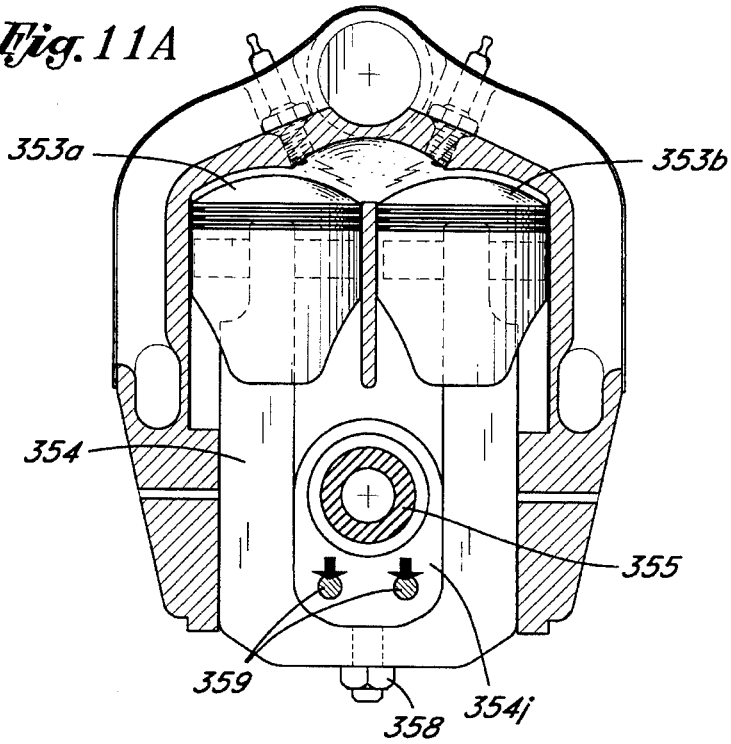
Figure 11B:
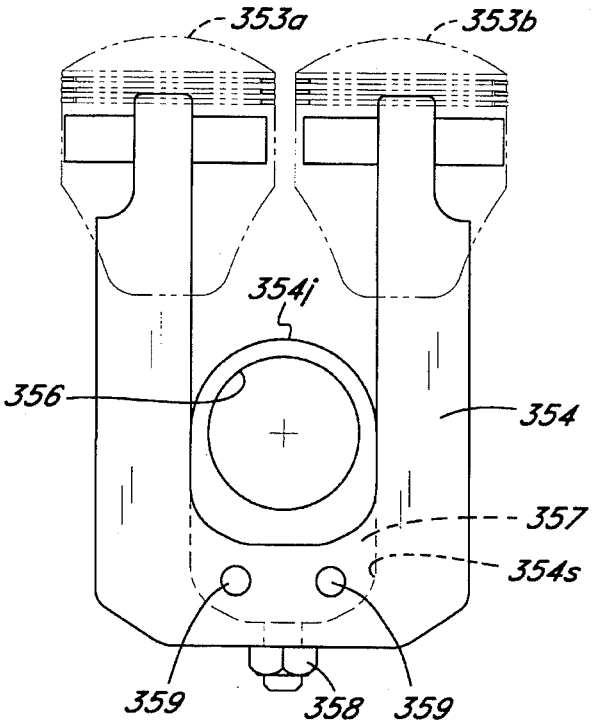
Figure 11C:
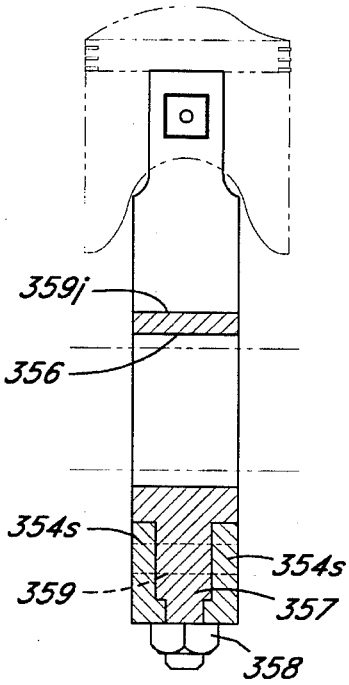

Referring now to FIGS. 11A–11C, it can be seen that this embodiment similarly comprises a U-shaped piston rod 354 and journal 354*j* that are mechanically secured to each other by a bolt 358. The U-shaped piston rod 354 has a seat 354*s* which engages both sides of a flange 357 extending downward form journal 354*j*. The journal 354*j* and U-shaped piston rod 354 are aligned by passing pins 359 through holes in the flange 357 of journal 354*j* and the seat 354 of U-shaped piston rod 354. The embodiment of FIGS. 10A–C is different from the embodiment of FIGS. 11A–C in the configuration of the seat and journal.

F. Power Cycle Operation

Figure 18A:
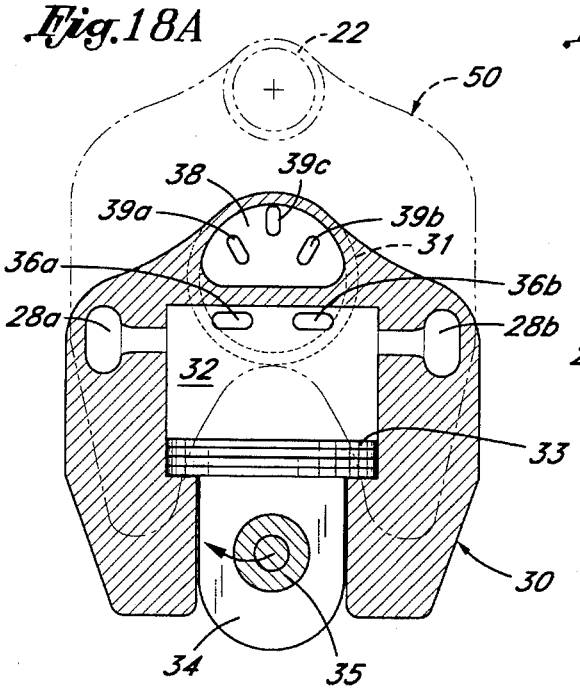
FIGS. 18A, 19A, 20A and 21A are cross-sectional front views of the air cylinder of FIG. 2 (with power cylinder in phantom) showing sequential steps of operation.

Now that the components associated with the air cylinder 30 and power cylinder have been described, cyclical operation of the reciprocating pistons within each cylinder, as well as simultaneous oscillation of both cylinders, can now be described more effectively. Reference is now made to FIGS. 18A, B–21A, B. Specifically, FIGS. 18A, 19A, 20A and 21A show the position of both the air cylinder 30 and the air piston 33 relative to the air crank throw 35 during the four steps of the power cycle. The power cylinder is shown in phantom. FIGS. 18B, 19B, 20B and 21B illustrate the corresponding position of the power cylinder 50 and the dual power pistons 53*a,b* relative to the power crank throw 55. The illustrations of FIGS. 18B, 19B, 20B and 21B show the power cylinder as viewed from the air cylinder, as is apparent by comparing these figures with the phantom portion of FIGS. 18A, 19A, 20A and 21A. Together, these four figures illustrate one power producing cycle or, in other words, one 360° rotation of the crankshaft assembly 80.

As seen in FIG. 18A, the power cycle will be assumed to begin with inlet of fresh air into the air cylinder 30 through inlets 28*a,b*. The air cylinder 30 and the power cylinder 50 are aligned at this time. The air piston 33 is at the bottom dead center position of the air cylinder 30. By comparison with FIG. 18B, it is clear that the air piston 33 is 180° out of phase with the power pistons 53*a,b* which are positioned at the top dead center of the power cylinder 50 at this time. It can be appreciated that as air enters the air cylinder 30 through inlets 28*a,b*, combustion takes place in the combustion chamber 51*c* at the inward-most portion of the power cylinder 50.

Figure 19A:
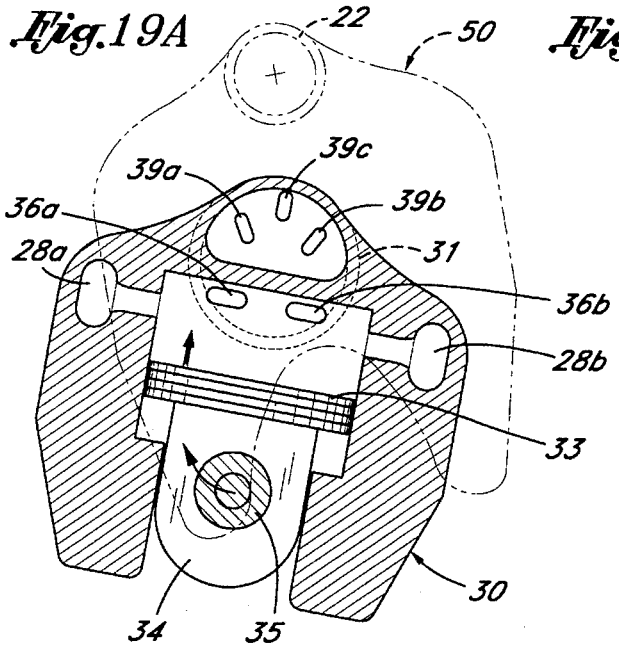

As shown in FIG. 19A, as the power cycle begins, the air cylinder 30 fills with a fresh air charge and the air piston 33 begins to move inward as the air crank throw 35 rotates clockwise. Oscillation of the air cylinder 30 takes the inlet ports 28*a,b* of air cylinder 30 out of alignment with air passageway ports 26*a,b* of power cylinder 50, thus preventing further flow of air into the air cylinder. The air within the air cylinder 30 is then compressed by inward movement of the air piston 33.

Figure 19B:
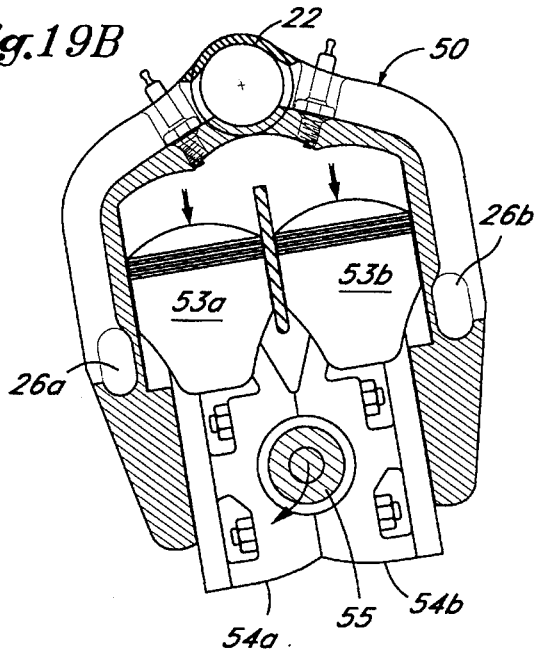

At the same time, as seen in FIG. 19B, the force provided by the expansion of the ignited fuel and air mixture in combustion chamber 51*c* causes the dual power pistons 53*a,b* to move outwardly in the power cylinder 50. Simultaneously, the power cylinder 50 oscillates with the power trunnion tube 22, tracking clockwise movement of the power crank throw 55.

Figure 20A:
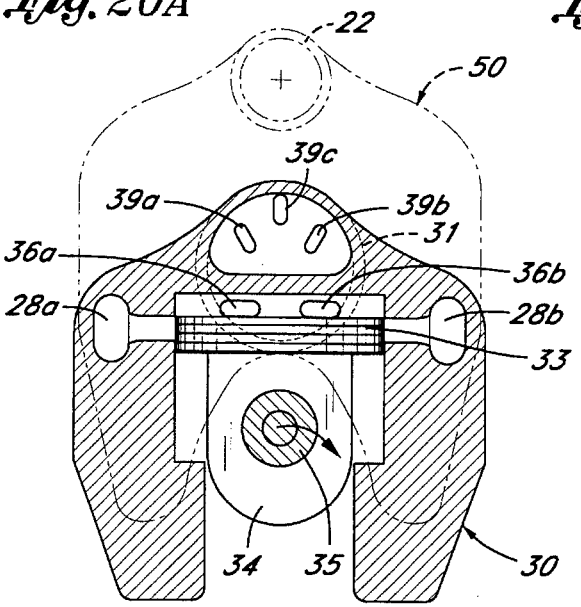
Figure 20B:
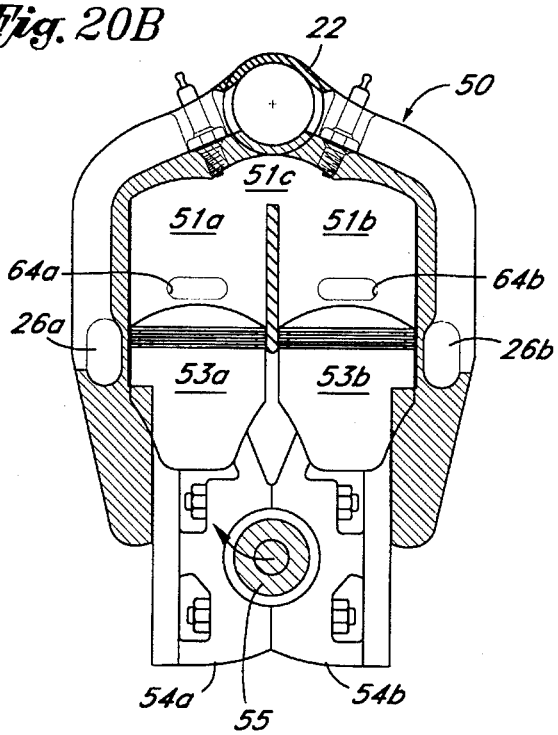

As appreciated from FIGS. 20A and 20B, when the power pistons 53*a,b* are at their bottom dead center position in the power cylinder 50 and the air piston 33 is at its top dead center position in the air cylinder 30, the power cylinder 50 and the air cylinder 30 are again aligned and parallel. The first set of exhaust ports 36*a,b* in the air trunnion 31 adjacent the power cylinder 50 becomes aligned with inlet ports 62*a,b* (not shown) of the power cylinder 50. This allows a large portion of the compressed air in the air cylinder 30 to flow rapidly into the barrels 51*a,b* of power cylinder 50. At the same time, a certain amount of compressed air in the air cylinder is directed into pre-combustion chamber 38 above barrel 32. Because the power pistons 53*a,b* are at their outward-most point, the exhaust ports 64*a,b* (FIG. 4) are exposed permitting the incoming air from the air cylinder 30 to purge spent gases out of power cylinder 50 through the exhaust ports 64*a,b*.

Figure 18B:
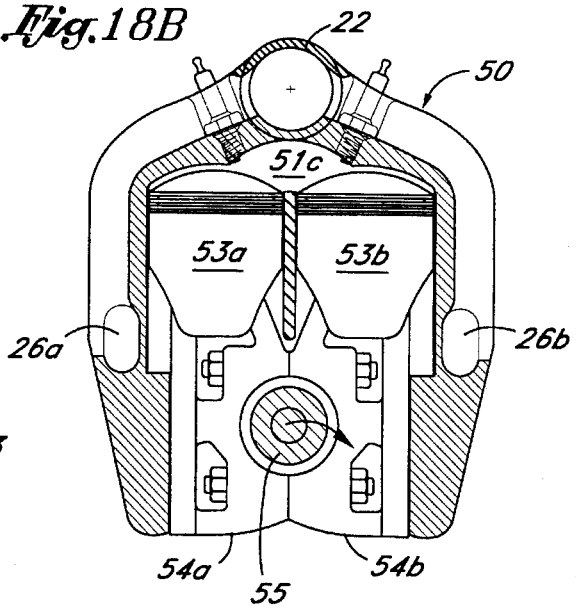
FIGS. 18B, 19B, 20B and 21B are cross-sectional rear views of the power cylinder of FIG. 2 showing sequential steps of operation corresponding to sequential steps of FIGS. 18A, 19A, 20A and 21A, respectively.
Figure 21A:
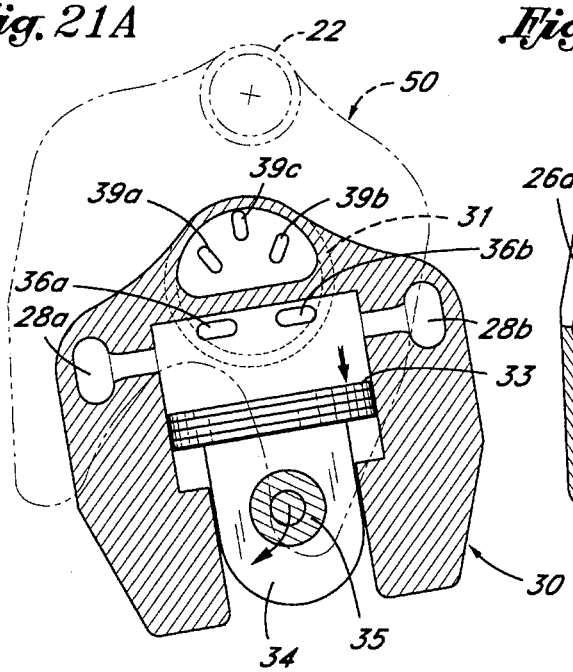
Figure 21B:
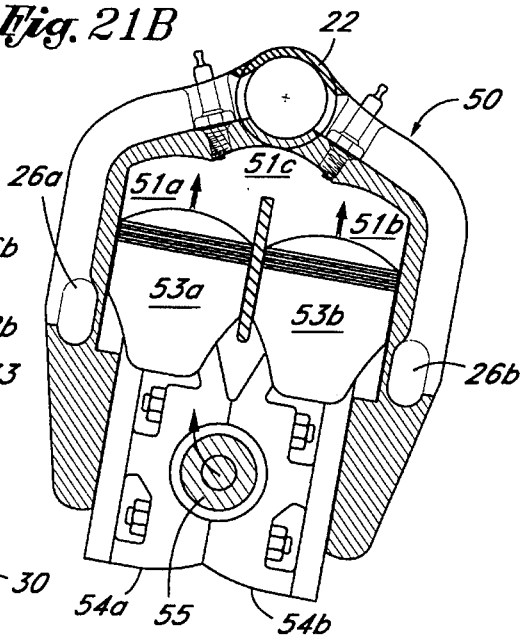

As shown in FIGS. 21A and 21B, as the power pistons 53*a,b* move inward from their bottom dead center position, the power cylinder 50 oscillates with power trunnion tube 22. As the power cylinder and air cylinder again oscillate out of alignment, the air cylinder exhaust ports 39*a–c* fall into alignment with power cylinder inlet ports 63*a–c* (not shown), permitting fuel and some additional pressurized air to enter the power cylinder from the pre-combustion chambers 38*a,b*. At that point, spent gases have been purged and power cylinder exhaust ports 64*a,b* are closed, preventing any inadvertent loss of fuel out the exhaust system 70. The corresponding ports 39*a–c* and 63*a–c* remain in alignment only momentarily so that, by the time the power pistons 53*a,b* are at their most inward point, these ports are closed during combustion. The inward movement of the power pistons 53*a,b* compress the air in the barrels 51*a,b* and combustion chamber 51*c* until the power pistons 53*a,b* reach their top dead center position and the power cylinder 50 is again ready for ignition and combustion (FIG. 18B). Simultaneously, the air piston 33 moves fully outward to eventually draw fresh air into the air cylinder 30 (FIG. 18A).

Operation of the oscillating cylinders in the unique arrangement of the present invention should now be sufficiently understood. One should readily appreciate the importance of timing with the present invention to maximize the purging of all spent gases with only a minimal loss of fresh incoming gases prior to combustion. If timed correctly, no fuel loss should be experienced before combustion as well.

As appreciated from FIG. 7, a significant feature of the first preferred embodiment of the improved engine 10 is the pressure or force upon each power piston 31 from the combustion of the fuel is equal because the dual power cylinders 50 share a common combustion chamber 51*c*. This causes the internal forces and loads from the engine's operation to be balanced and act equally on the dual power pistons 53*a,b*. Additionally, the oscillating motion of the cylinders 50 causes the force on each power pistons 53*a,b* to be directed through the centerline of each of the power piston rods 54*a,b*. The force on the power crank throw 55 of the crankshaft assembly 80 is also balanced because the power piston rods 54*a,b* act equally upon the power crank throw 55, as described above.

Figure 16:
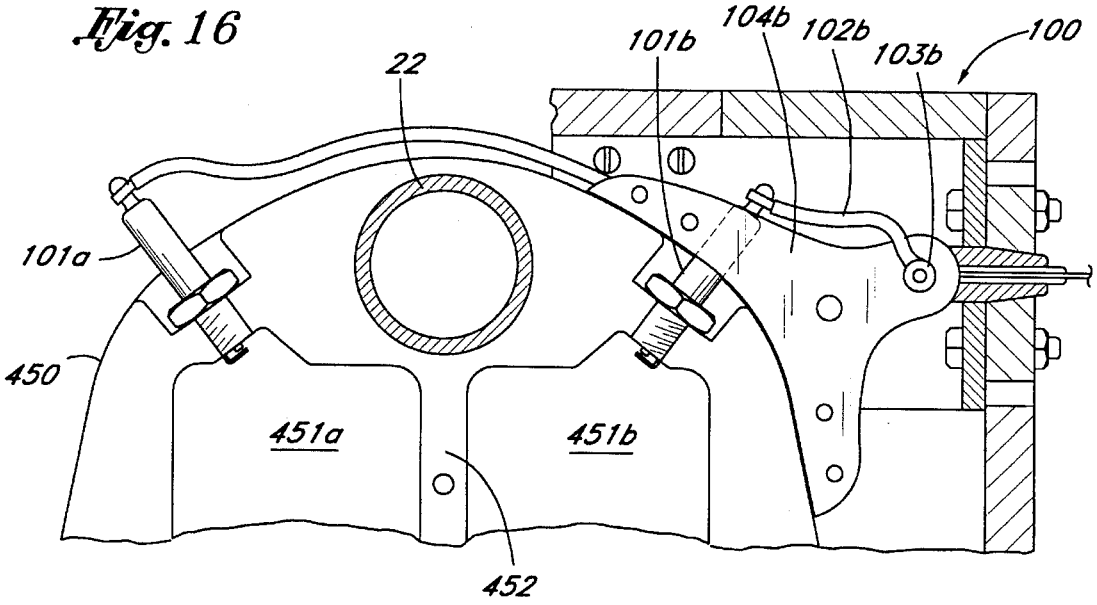
FIG. 16 is a fragmentary cross-sectional front view of the electrical ignition system as applied to an alternative power cylinder embodiment of the present invention.

Referring momentarily back to FIG. 16, another embodiment of the power cylinder is illustrated. There, a different power cylinder 450 is illustrated including separate barrels 451*a,b* each of which has its own separate combustion chamber separated by a dividing wall 452 extending all the way up to the head of the cylinder. Even with this arrangement, the power pistons (not shown) may still be interconnected by power piston rods located on each side of the power crank throw, as described above in association with FIGS. 7–11C.

G. Crankshaft Assembly

A detailed description of other features of the present invention may now be described. Referring back to FIG. 2, it can be seen that the crankshaft assembly 80 is positioned parallel to power trunnion tube 22 and is held in position by the three parallel crankcase support plates 14, 15 and 16. Thus, these crankcase support plates not only support the air trunnions 31 and power trunnion tube 22, but also the crankshaft assembly 80. The crankshaft assembly 80 includes a plurality of separate members that are interconnected by mechanical fasteners, such as bolts 81 (shown in phantom). These separate members include the air crank throw 35 and the power crank throw 55 which are securely held together by the bolts 81. Constructing the crankshaft assembly 80 out of separate members allows it to be easily disassembled and readily serviced. This facilitates the removal of a worn rod journal pin giving a new interrace roller bearing.

Referring back to FIG. 1, the improved engine 10 preferably includes two power modules arranged in a side-by-side relationship. Each module transfers the generated power to the crankshaft 80 that is selectively connected to a central drive shaft 110 by a slidable output gear 112. The slidable output gear 112 is selectively connected to the crankshaft 80 by pins 114 and 116 that fit within openings in the end of each crankshaft 80. When the power from the selected power module is desired to be connected to the central drive shaft 110, the output gear 112 is moved such that the pins 114 and 116 engage the openings. Alternatively, when the pins 114 and 116 are disengaged from the crankshaft 80, the module is not connected to the central drive shaft 110. Thus, the output gear 112 located between the two modules can engage both of the crankshafts 80 of the side-by-side modules (as shown), or the output gear 112 may be moved such that it only engages a single module.

H. Variable Compression Ratio System

Figure 14:
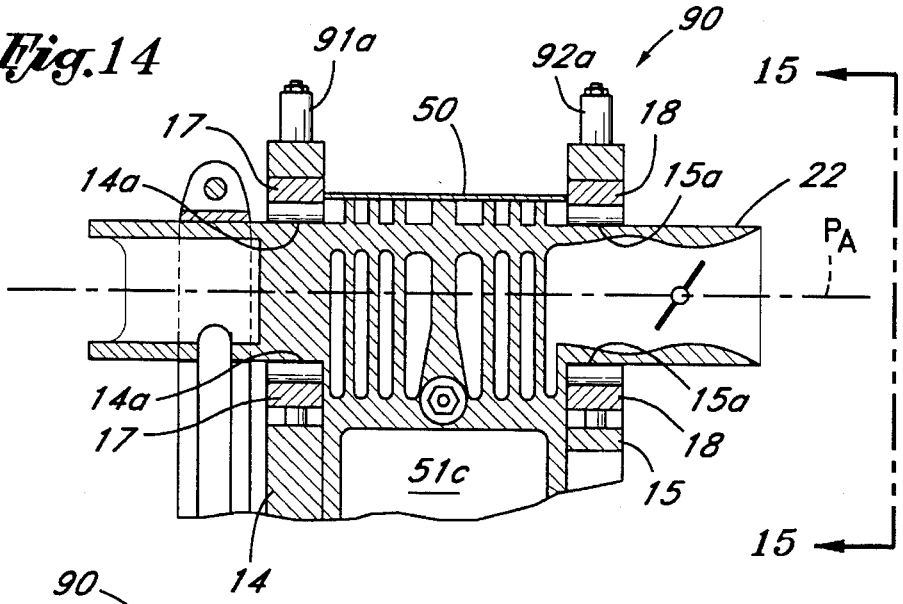
FIG. 14 is a fragmentary cross-sectional side view of the variable compression ratio mechanism as applied to the embodiment of FIG. 2.
Figure 15:
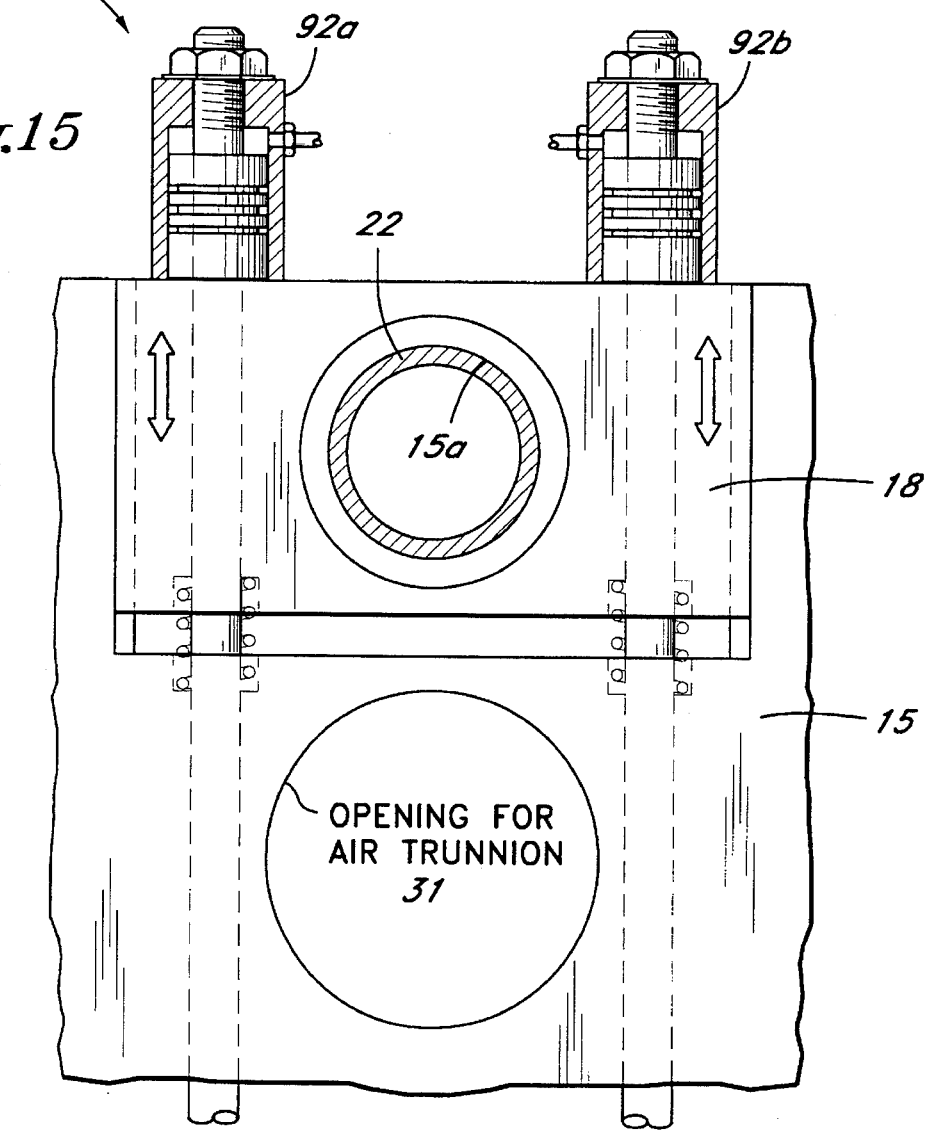
FIG. 15 is a front view of the variable compression ratio mechanism of FIG. 14 taken along lines 15—15.

Referring now to FIGS. 14 and 15, the variable compression ratio system 90 can be described. The purpose of the variable compression ratio system is to control the amount of desired pressure developed in the combustion chamber 51*c*. The variable compression ratio system 90 allows varying degrees of compression to accommodate the use of different types of fuel and to accommodate fuels having different levels of octanes. Broadly, the pressure is controlled by adjusting the volume of the combustion chamber 51*c* in the power cylinder in which the fuel mixture is compressed. The volume is adjusted by varying the distance between the axis of rotation $P_A$ of the power trunnion tube 22 and power pistons 53*a,b*. As shown in FIG. 14, the power trunnion tube 22 extends through, and is supported by, bearings located within an opening 14*a* in crankcase support plate 14 and an opening 15*a* in crankcase support plate 15. The openings 14*a* and 15*a* are contained within linearly movable compression plates 17 and 18 of the crankcase support plates 14 and 15, respectively, which movable compression plates 17 and 18 move relative to the balance of crankcase support plates 14 and 15. Because the power cylinder 50 is integral with the power trunnion tube 22, an operator moving compression plates 17 and 18 necessarily moves the power trunnion tube 22 (and power cylinder 50) relative to the power pistons 53*a,b* and the crankshaft assembly 80 (not shown). This adjustment changes the size of the combustion chamber 51*c*.

Movement of compression plates 17 and 18 is controlled by a first set of hydraulic assemblies 91*a* and 92*a* (FIG. 14) and a second set of hydraulic assemblies 91*b* (not shown) and 92*b* (FIG. 15). As shown more clearly in FIG. 15, the hydraulic assemblies 92*a* and 92*b* preferably comprise pistons translated linearly within cylinders by the flow of hydraulic fluid on either side of the pistons. Movement of the hydraulic pistons results in linear movement of the power trunnion tube in a direction normal to its axis of rotation, as shown by the arrows. While FIG. 15 shows the hydraulic assemblies 92*a,b* for moving compression plate 18 of support plate 15, it should be understood that compression plate 17 of support plate 14 is similarly controlled by hydraulic assemblies 91*a* (FIG. 14) and 91*b* (not shown). However, it is contemplated that other mechanical systems may be employed for moving the power trunnion tube 22 relative to the power pistons 53*a,b* in order to vary the compression ratio.

With the present invention, it is contemplated that an electronic sensor will be positioned in the gas tank to detect the octane levels of the fuel. Controls linked to the sensor will then hydraulically move the compression plates accordingly. It is also contemplated that a bubble level can be used at some location within the vehicle to which the present invention is incorporated in order to detect whether the vehicle is moving up or down a grade. The compression ratio may be varied to respond to travel up or down a grade to increase compression as needed—i.e., either to increase power or to function as a brake, respectively.

I. Electrical Ignition System

Figure 17:
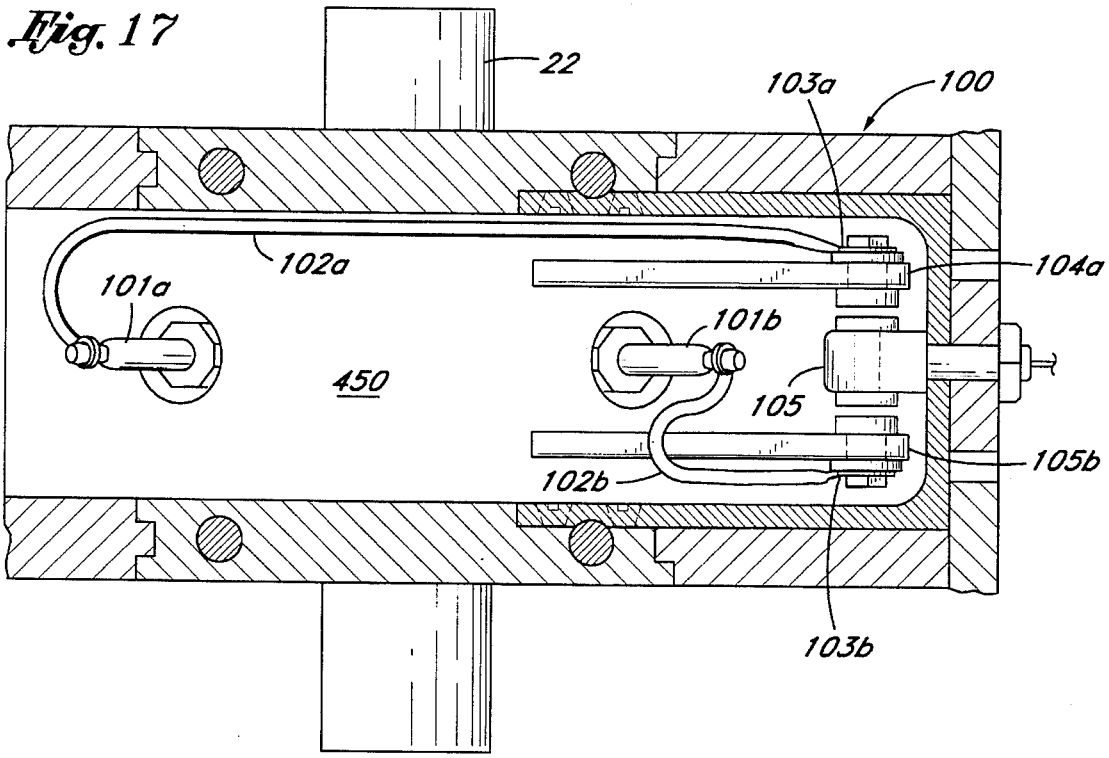
FIG. 17 is a top view of the electrical ignition system of FIG. 16.

Referring now to FIGS. 16 and 17, the electrical ignition system 100 can be described in detail. The electrical ignition system 100 relies upon the oscillating motion of the power cylinder 450 to control the delivery of electrical charges to spark plugs 101*a,b* at the top of the power cylinder. As shown in FIG. 16, the spark plugs 101*a,b* protrude through the head of the power cylinder 450 so that they project into combustion chambers of barrels 451*a*, 451*b*. While FIG. 16 shows spark plugs delivering a spark to two separate combustion chambers, in accordance with the alternative embodiment described below, the spark plugs may be employed with a single shared combustion chamber, as described above and shown in FIG. 7. Depending upon the specific burn pattern or combustion characteristics desired, the number of spark plugs may be varied. Additionally, the location of the spark plugs 101 in the combustion chambers 451*a*, 451*b* may also be varied as required.

Referring to FIG. 17, the timing of the electrical current provided to the spark plugs is controlled by oscillation of the power cylinder 450. Each spark plug 101 is serviced by a spark plug wire 102 having a lead at a distal end connected to an electrical contact 103 supported by a bracket 104. Both electrical contacts 103 surround a center electrode 105 that is connected to an electrical source such as a battery (not shown). Oscillation of the power cylinder 450 periodically aligns the center electrode 105 with both electrical contacts 103 to allow electrical current to flow from the center electrode 105, through the electrical contacts 103 and spark plug wires 102, to the spark plugs 101. Thus, like the delivery of fuel and air into the power cylinder 450, the firing of spark plugs 101 and ignition of the fuel-air mixture in the combustion chambers 451*a,b* are controlled by oscillation of the power cylinder 450.

It should be understood and appreciated that any desired number of power modules may be employed either in side-by-side relation, as shown in FIG. 1 (##11 and 12), or at various angular intervals about a common axis in order to obtain the desired power output and capacity of the device. Moreover, one or more power modules and central drive shafts may be combined according to the desired power output of the engine.

The present invention may be embodied in other specific forms without departing from its spirit or essential characteristics. The described embodiments are to be considered in all respects only as illustrative, and not restrictive. The scope of the invention is, therefore, indicated by the appended claims, rather than the foregoing description. All changes which come within the meaning and range of equivalency of the claims are to be embraced within their scope.

I claim:

1. An improved engine for maximizing combustion efficiently by minimizing the loss of fuel through exhaust flow and maximizing the purge of spent gases prior to a subsequent combustion step, said improved engine including a module having a fuel delivery system and corresponding first and second oscillating cylinders, the first cylinder being an air cylinder for compressing air, and the second cylinder being a power cylinder for effectuating combustion of fuel and air during periodic combustion steps, the improvement comprising:

an air intake assembly comprising a set of power trunnions that support the power cylinder in an oscillating manner, the power trunnions comprising, in part, a hollow power trunnion conduit to allow external air to pass therethrough to the air cylinder;

a pre-combustion chamber positioned downstream from the air cylinder and upstream from the power cylinder, said pre-combustion chamber periodically containing a portion of compressed air delivered from the air cylinder, said portion of compressed air being deliverable into the power cylinder after a substantial balance of air from the air compression cylinder has been delivered immediately therebefore into the power cylinder.

2. The improvement of claim 1 further comprising a set of air trunnions positioned coaxially with respect to each other and further positioned in non-collinear relationship with the power trunnion conduit so as to preclude fluid communication between said power trunnion conduit and the set of air trunnions.

3. The engine of claim 1 wherein said power cylinder comprises first and second barrels each housing a reciprocating piston, said barrels sharing a common combustion chamber to contain ignition and combustion of air and fuel so as to permit expanding gases resulting from combustion to redirect said pistons away from said combustion chamber in a manner which causes the power cylinder to oscillate.

4. The engine of claim 1 wherein the pre-combustion chamber houses a portion of the fuel delivery system, said fuel delivery system comprising, in part, a discharge nozzle for ejecting fuel into the power cylinder.

5. The engine of claim 1 wherein the power cylinder includes a baffle for directing incoming air away from an exhaust port of said power cylinder such that the volume of incoming air purges substantially all spent air from the power cylinder before fuel is introduced into said power cylinder for a subsequent combustion step.

6. An internal combustion engine comprising an air cylinder and power cylinder each oscillating independently about separate axes that are concentric with separate first and second sets of trunnions which are in non-collinear relationship with each other, the first set of trunnions being air trunnions for supporting the air cylinder in an oscillating fashion, the second set of trunnions being power trunnions for supporting the power cylinder in an oscillating fashion, the power cylinder trunnions comprising, in part, a hollow power trunnion conduit that is configured to be in fluid communication with an external air source in one direction and with said air cylinder in an opposing direction wherein the air cylinder includes exhaust ports that permit fluid communication with the power cylinder in such a manner that air is delivered to said power cylinder in two discrete stages, the first stage introducing only air so as to purge spent gases out of said power cylinder, the second stage being a combination of air and fuel for combustion within said power cylinder.

7. The engine of claim 6 further comprises an exhaust system for directing spent gases from the power cylinder into a portion of the power trunnion conduit for release outside of said engine.

8. The engine of claim 6 further comprising a fuel delivery system that periodically delivers fuel to the power cylinder for subsequent combustion.

9. The engine of claim 6 wherein the power cylinder includes first and second barrels each housing a reciprocating piston, the first and second barrels sharing a common combustion chamber to enclose ignition and combustion of air and fuel so as to permit expanding gases resulting from combustion to redirect the pistons away from the combustion chamber in a manner which causes said power cylinder to oscillate.

10. The engine of claim 8 wherein the fuel delivery system includes first and second delivery nozzles for delivering fuel to first and second barrels, respectively, within the power cylinder.

11. The engine of claim 8 or 10 wherein the fuel delivery system includes a delivery nozzle for delivering fuel to the combustion chamber within the power cylinder.

12. An improved engine including a module having first and second oscillating cylinders, the first cylinder being an air cylinder for compressing air for delivery to the second cylinder, said second cylinder being a power cylinder for effectuating combustion of fuel and air, the improvement comprising:

a set of power trunnions for supporting the power cylinder, at least one of said power trunnions permitting the passage of air therethrough from an external air source to the air cylinder;

a plurality of barrels integral with the power cylinder and positioned therein, each barrel housing a separate piston and being in fluid communication with a combustion chamber at an inward-most portion of said power cylinder, said pistons each directly linked to a mechanically-unitary piston rod assembly comprising discrete piston rods mechanically linked to a single power crank throw, said pistons moving reciprocally in unison in response to a force exerted in one direction by the power crank throw and to an opposing force exerted by expanding gases resulting from combustion.

13. The improvement of claim 12 further comprising a pre-combustion chamber positioned downstream from the air cylinder and upstream from the power cylinder, said pre-combustion chamber periodically containing a portion of compressed air delivered from the air cylinder, said portion of compressed air being deliverable into the power cylinder after a substantial balance of air from the air compression cylinder has been delivered into the power cylinder immediately therebefore.

14. The improvement of claim 13 further comprising a fuel delivery system configured to release fuel into the power cylinder contemporaneously with the delivery of said portion of compressed air into said power cylinder.

15. The engine of claim 14 wherein said fuel delivery system includes first and second nozzles for delivering fuel to first and second barrels, respectively, within the power cylinder.

16. The engine of claim 12 wherein the air cylinder houses a reciprocating air piston linked to an air crank throw, the power crank throw and the air crank throw being discrete components mechanically linked to a crankshaft assembly.

17. The engine of claim 12 wherein the power trunnions comprise a hollow conduit located substantially above the combustion chamber of the power cylinder.

18. The engine of claim 12 wherein the power trunnions are linearly movable relative to the power pistons for purposes of changing the volume of the combustion chamber.

19. The engine of claim 12 wherein the power trunnions are each supported by a movable portion of one of two crank case support plates, the movable portions being movable relative to the power cylinder pistons for purposes of changing the volume of the combustion chamber.

20. The engine of claim 12 wherein the barrels are in fluid communication with separate combustion chambers.

21. The engine of claim 12 wherein each piston is rigidly joined to the piston rod assembly.

* * * * *